US010377158B2

(12) United States Patent
Sakuwa et al.

(10) Patent No.: US 10,377,158 B2
(45) Date of Patent: Aug. 13, 2019

(54) THERMAL PRINTER

(71) Applicant: MITSUBISHI ELECTRIC CORPORATION, Tokyo (JP)

(72) Inventors: Makoto Sakuwa, Tokyo (JP); Yoshifumi Yamamoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/738,083

(22) PCT Filed: Apr. 7, 2017

(86) PCT No.: PCT/JP2017/014488

§ 371 (c)(1),
(2) Date: Dec. 19, 2017

(87) PCT Pub. No.: WO2018/185925

PCT Pub. Date: Oct. 11, 2018

(65) Prior Publication Data

US 2018/0304657 A1 Oct. 25, 2018

(51) Int. Cl.

| | |
|---|---|
| ***B41J 29/17*** | (2006.01) |
| ***B41J 2/32*** | (2006.01) |
| ***B41J 2/325*** | (2006.01) |
| ***B41J 2/175*** | (2006.01) |
| ***B41J 29/38*** | (2006.01) |
| ***B41J 11/70*** | (2006.01) |
| *B41J 2/165* | (2006.01) |

(52) U.S. Cl.
CPC ..... *B41J 29/17* (2013.01); *B41J 2/175* (2013.01); *B41J 2/32* (2013.01); *B41J 2/325* (2013.01); *B41J 11/70* (2013.01); *B41J 29/38* (2013.01); *B41J 2/165* (2013.01)

(58) Field of Classification Search
CPC ... B41J 29/17; B41J 11/70; B41J 29/38; B41J 2/175; B41J 2/325; B41J 2/32; B41J 2/165
See application file for complete search history.

(56) References Cited

U.S. PATENT DOCUMENTS

2013/0286139 A1* 10/2013 Furuki ..... B41J 2/325 347/217

FOREIGN PATENT DOCUMENTS

| | | | | |
|---|---|---|---|---|
| JP | 1-258977 A | | 10/1989 | |
| JP | 01258977 A | * | 10/1989 | ..... B41J 31/05 |
| JP | 9-202023 A | | 8/1997 | |
| JP | 11-058901 | * | 3/1999 | ..... B41J 2/32 |
| JP | 2016-193570 A | | 11/2016 | |

OTHER PUBLICATIONS

Extended European Search Report dated Feb. 22, 2019 issued in corresponding European Patent Application No. 17904737.8.

* cited by examiner

*Primary Examiner* — Yaovi M Ameh
(74) *Attorney, Agent, or Firm* — Birch, Stewart, Kolasch & Birch, LLP

(57) ABSTRACT

A thermal printer uses an ink ribbon having a function of performing cleaning of a thermal head by being heated. The thermal printer performs a cleaning process of performing cleaning of the thermal head. In the cleaning process, the thermal head applies, to the ink ribbon, heat of a heat quantity with which a dye applied onto the ink ribbon does not sublime and with which the cleaning is performed.

7 Claims, 13 Drawing Sheets

THERMAL PRINTER

TECHNICAL FIELD

The present invention relates to a thermal printer having a function of cleaning a thermal head.

BACKGROUND ART

With a thermal printer, it is required to periodically perform cleaning of a thermal head. Patent Document 1 discloses a structure for performing cleaning of a thermal head (hereinafter referred to as the "related structure A"). In the related structure A, a cassette head cleaner including a cleaning sheet is attached to a thermal printer, to perform cleaning of the thermal head. Thus, any attached substance deposited on the thermal head is removed.

PRIOR ART DOCUMENTS

Patent Documents

Patent Document 1: Japanese Patent Application Laid-Open No. 2016-193570

SUMMARY

Problems to be Solved by the Invention

However, with the related structure A, in performing cleaning of the thermal head, it is required to remove an ink ribbon (an ink ribbon cassette) from the thermal printer, and thereafter attach a cassette head cleaner to the thermal printer. Accordingly, there exists a problem that, in performing cleaning of the thermal head, a cleaning-dedicated cassette head cleaner must be provided.

The present invention has been made to solve such a problem, and an object thereof is to provide a thermal printer with which cleaning of a thermal head can be performed without the necessity of using a cassette head cleaner.

Means to Solve the Problems

In order to achieve the object, a thermal printer according to one aspect of the present invention performs a printing process for forming an image on recording paper using an ink ribbon having a function of performing cleaning of a thermal head by being heated. The thermal printer includes the thermal head having a function of emitting heat, and a printing control unit controlling the thermal head. The thermal printer performs a cleaning process of performing the cleaning of the thermal head. In the cleaning process, in accordance with control of the printing control unit, the thermal head applies, to the ink ribbon, heat of a heat quantity with which a dye applied onto the ink ribbon does not sublime and with which the cleaning is performed.

Effects of the Invention

According to the present invention, the thermal printer uses an ink ribbon having a function of performing cleaning of a thermal head by being heated. The thermal printer performs a cleaning process of performing the cleaning of the thermal head. In the cleaning process, the thermal head applies, to the ink ribbon, heat of a heat quantity with which a dye applied onto the ink ribbon does not sublime and with which the cleaning is performed. Thus, cleaning of the thermal head can be performed without the necessity of using a cassette head cleaner.

The object, characteristics, aspects, and advantages of the present invention will become more apparent from the following detailed description and accompanying drawings.

DESCRIPTION OF EMBODIMENTS

Figure 1:
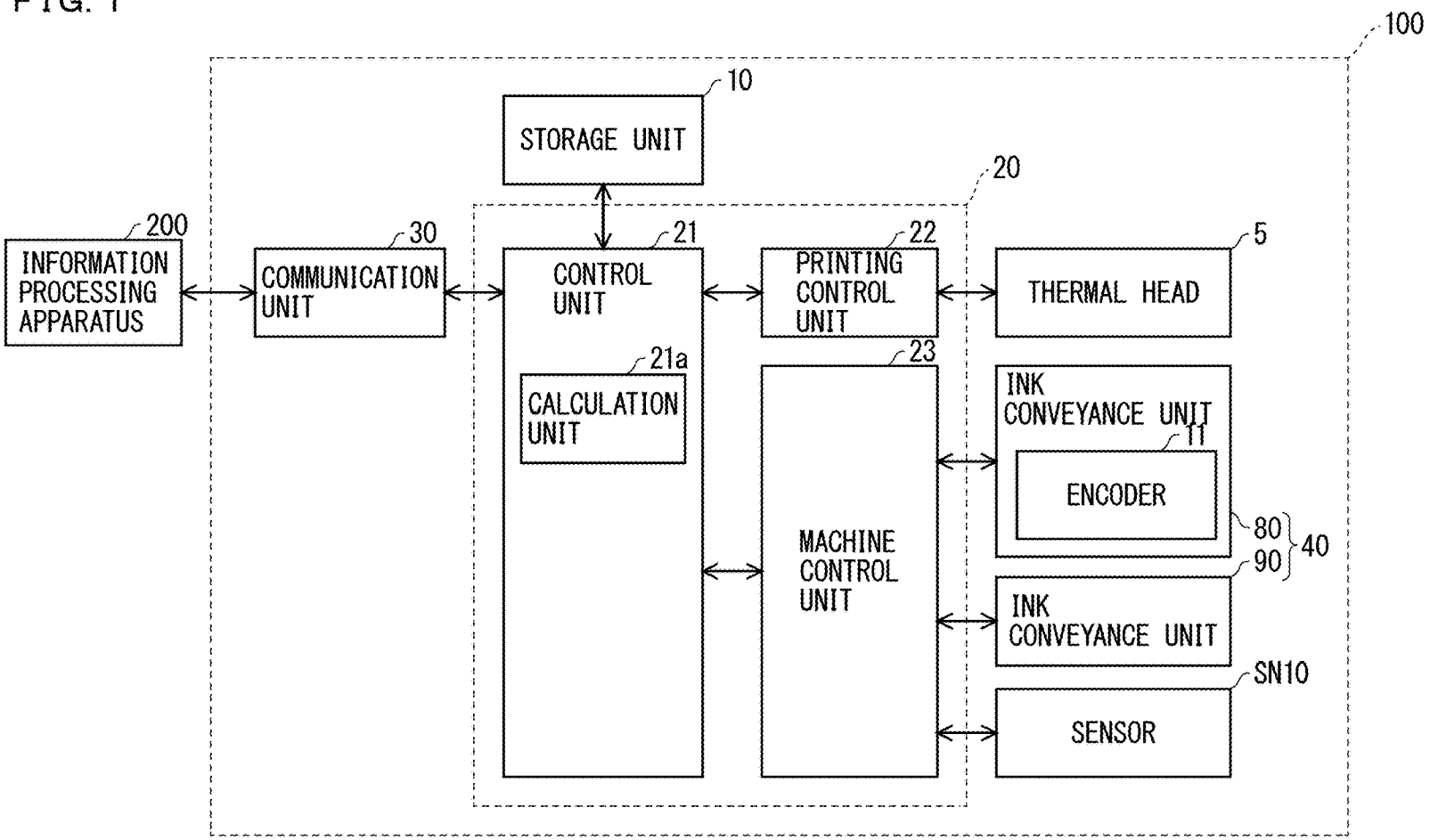
FIG. 1 is a block diagram showing the schematic structure of a thermal printer according to a first embodiment of the present invention.

In the following, with reference to the drawings, a description will be given of embodiments of the present invention. In the drawings referred to hereinafter, identical constituents are denoted by an identical reference character. The constituents denoted by an identical reference character have identical name and functions. Accordingly, a detailed description of part of the constituents denoted by an identical reference character may be omitted.

Note that, the dimension, material, shape, and relative position of constituents exemplarily shown in the embodiments may be modified as appropriate depending on the structure, various conditions and the like of the apparatus to which the present invention is applied.

First Embodiment

FIG. 1 is a block diagram showing the schematic structure of a thermal printer 100 according to a first embodiment of the present invention. Note that, for the sake of convenience, FIG. 1 also shows an information processing apparatus 200 not included in the thermal printer 100.

While details will be described later, the thermal printer 100 performs a printing process P for forming an image on recording paper 6, which will be described later, using an ink ribbon 7, which will be described later. The information processing apparatus 200 is an apparatus that controls the thermal printer 100. The information processing apparatus 200 is, for example, a PC (Personal Computer). The information processing apparatus 200 is operated by the user.

When the user performs a printing execution operation on the information processing apparatus 200, the information processing apparatus 200 transmits a print instruction and image data D1 to the thermal printer 100. The printing execution operation is an operation for causing the thermal printer 100 to execute the printing process P. Further, the print instruction is an instruction for causing the thermal printer 100 to execute the printing process P. The image data D1 is data of an image to be printed on the recording paper 6, which will be described later.

With reference to FIG. 1, the thermal printer 100 includes a storage unit 10, a control unit 20, a communication unit 30, and a thermal head 5.

The storage unit 10 is memory that stores various types of data, programs and the like. The storage unit 10 is, for example, structured by non-volatile memory and volatile storage memory. The storage unit 10 stores, for example, a control program for controlling the thermal printer 100, data relating to control of printing, image data, print data, various types of data, various types of set values, various types of initial values and the like.

The thermal head 5 has a function of emitting heat. While details will be described later, the thermal head 5 emits heat in accordance with control of the control unit 20.

While details will be described later, the control unit 20 performs various processes on the units of the thermal printer 100. The control unit 20 performs the various processes according to a control program. The control unit 20 is, for example, a processor such as a CPU (Central Processing Unit).

The control unit 20 includes a control unit 21, a printing control unit 22, and a machine control unit 23. All or part of the control unit 21, the printing control unit 22, and the machine control unit 23 are structured by a signal processing circuit structured by a hardware electric circuit. Note that, all or part of the control unit 21, the printing control unit 22, and the machine control unit 23 may be a program module executed by the control unit 20.

While details will be described later, the control unit 21 mainly performs a process of controlling the entire thermal printer 100. Further, the control unit 21 makes access to the storage unit 10, and reads out data and the like stored in the storage unit 10 as necessary.

The control unit 21 includes a calculation unit 21*a*. The calculation unit 21*a* is described in the following. The calculation unit 21*a* is a program module executed by the control unit 21. In other words, the calculation unit 21*a* is realized by the control unit 21 performing various types of processes in accordance with a software program stored in memory or the like. Note that, the calculation unit 21*a* may be structured by a signal processing circuit structured by a hardware electric circuit that performs the various types of processes.

The printing control unit 22 controls the thermal head 5. While details will be described later, the printing control unit 22 performs a process for performing printing, using the thermal head 5. While details will be described later, the machine control unit 23 controls a mechanical structure included in the thermal printer 100 (hereinafter also referred to as the "mechanical structure") in accordance with control of the control unit 21. That is, the control unit 21 controls the mechanical structure via the machine control unit 23.

The communication unit 30 communicates with the information processing apparatus 200 and the control unit 21. The print instruction and the image data D1 transmitted by the information processing apparatus 200 are transmitted to the control unit 21 via the communication unit 30. The communication unit 30 establishes communication using, for example a USB (Universal Serial Bus) interface.

According to the received print instruction, the control unit 21 generates print data using the received image data D1. The print data is control data for printing an image represented by image data D1 on the recording paper 6. The control unit 21 transmits the print data to the printing control unit 22. According to the print data, the printing control unit 22 controls the quantity of heat emitted by the thermal head 5. Thus, the image represented by the image data D1 is printed on the recording paper 6.

Figure 2:
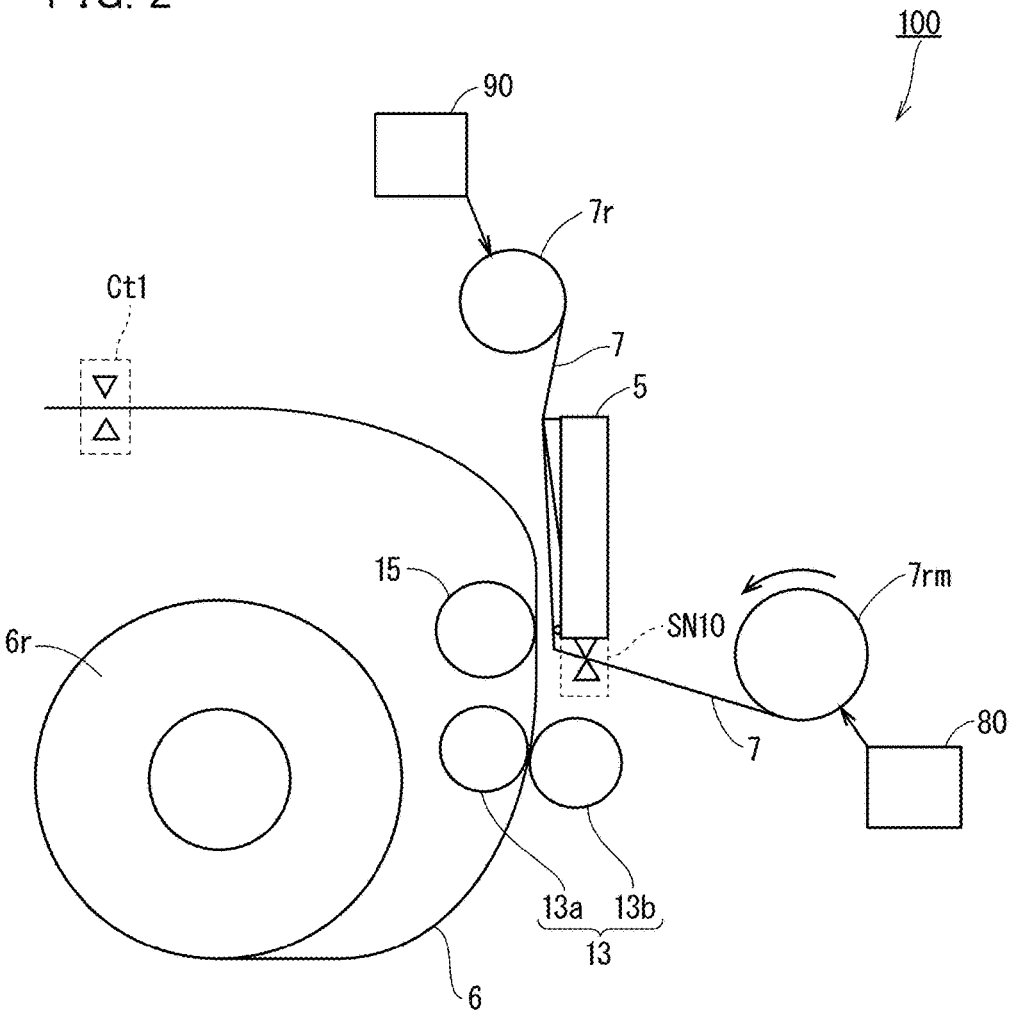
FIG. 2 is a diagram mainly showing a mechanical structure for performing printing in the thermal printer according to the first embodiment of the present invention.

FIG. 2 is a diagram mainly showing the mechanical structure for performing printing in the thermal printer 100 according to the first embodiment of the present invention. Note that, FIG. 2 shows the state where roll paper 6*r* and an ink ribbon 7 are attached to the thermal printer 100. The roll paper 6*r* is formed by elongated recording paper 6 being rolled up.

The ink ribbon 7 is an elongated sheet. By one end of the ink ribbon 7 being rolled up, an ink ribbon roll 7*r* is formed. The ink ribbon roll 7*r* is a roll that supplies the ink ribbon 7 (hereinafter also referred to as the "supply-side roll").

By other end of the ink ribbon 7 being rolled up, an ink ribbon roll 7*rm* is formed. The ink ribbon roll 7*rm* is a roll for taking up the ink ribbon 7 (hereinafter also referred to as the "take-up-side roll").

The thermal printer 100 is structured so that the ink ribbon rolls 7*r*, 7*rm* are removably attached to the thermal printer 100.

While details will be described later, the thermal printer 100 performs a printing process P for forming an image on the recording paper 6. While details will be described later, the printing process P is a process for transferring dyes 7*y*, 7*m*, 7*c* onto the recording paper 6.

Figure 3:
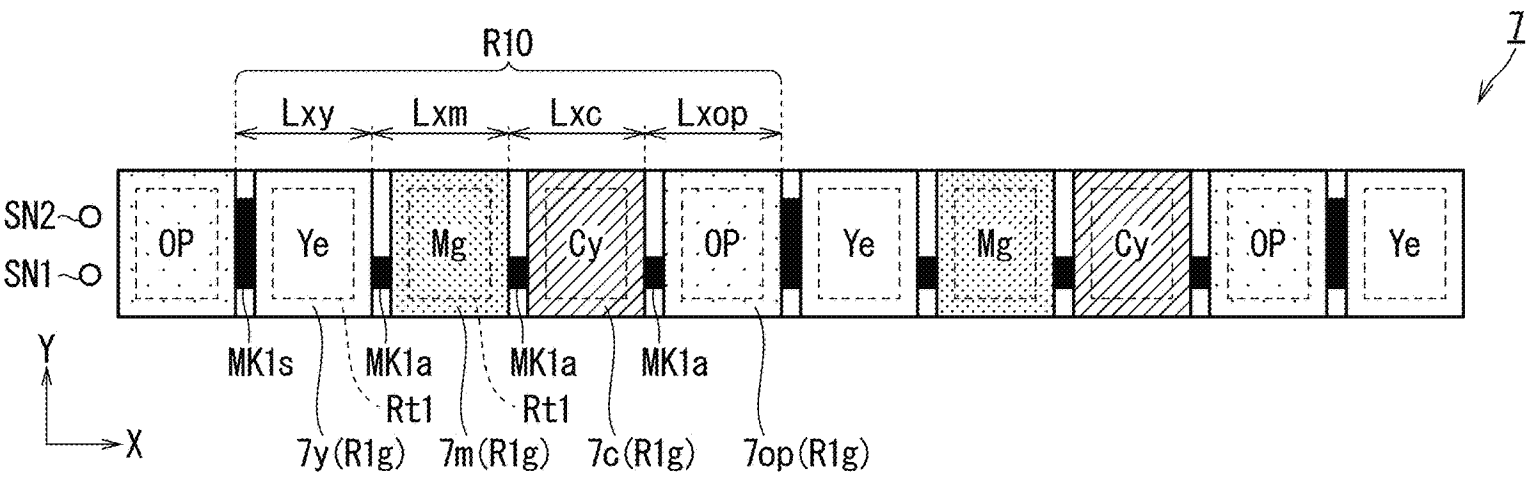
FIG. 3 is a diagram for describing part of an ink ribbon.

FIG. 3 is a diagram for describing part of the ink ribbon 7. Note that, FIG. 3 also shows sensors SN1, SN2 which will be described later. In FIG. 3, an X direction and a Y direction are perpendicular to each other. The X direction and the Y direction appearing in the subsequent drawings are also perpendicular to each other.

Hereinafter, a direction including the X direction and a direction opposite to the X direction (−X direction) is also referred to as the "X-axis direction". Further, in the following, a direction including the Y direction and a direction opposite to the Y direction (−Y direction) is also referred to as the "Y-axis direction". Further, hereinafter, a plane including the X-axis direction and the Y-axis direction is also referred to as the "XY-plane".

With reference to FIG. 3, the ink ribbon 7 is provided with a plurality of unit regions R10 each including dyes 7*y*, 7*m*, 7*c* and a protective material 7*op*, along the longitudinal direction (X-axis direction) of the ink ribbon 7. That is, onto the ink ribbon 7, the dyes 7*y*, 7*m*, 7*c* and the protective material lop are applied. Each of the dyes 7*y*, 7*m*, 7*c* and the protective material 7*op* is a material transferred onto the recording paper 6.

Each of the dyes 7*y*, 7*m*, 7*c* and the protective material lop is a transferred material that is transferred onto the recording paper 6 by being heated by the thermal head 5. For example, the dye 7*y* is a first transferred material. That is, the dye 7*y* is the material that is firstly transferred onto the recording paper 6 in the printing process P. Further, for example, the protective material 7*op* is a fourth transferred material.

Each of the dyes 7*y*, 7*m*, 7*c* shows a color to be transferred onto the recording paper 6 being the target of transfer. Specifically, the dyes 7*y*, 7*m*, 7*c* show the colors of yellow, magenta, and cyan, respectively. Hereinafter, yellow, magenta, and cyan are also referred to as "Ye", "Mg", and "Cy", respectively. Further, hereinafter, each of the dyes Ye, Mg, and Cy is also referred to as the "color dye". Each of the dyes 7*y*, 7*m*, 7*c* being the color dye is a dye used in forming an image.

The protective material 7*op* is a material for protecting the colors transferred onto the recording paper 6 (overcoat). Specifically, the protective material 7*op* is a material for protecting an image formed by the dyes 7*y*, 7*m*, 7*c* on the recording paper 6. Hereinafter, the protective material 7*op* is also referred to as the "OP material".

Each of the dyes 7*y*, 7*m*, 7*c* and the protective material 7*op* being the transferred material includes a transfer region Rt1. That is, the transfer regions Rt1 exist in the ink ribbon 7. The transfer region Rt1 is a transfer-source area in each of the transferred materials. Onto the transfer region Rt1 of the color dye, a dye (dyes 7*y*, 7*m*, used in forming an image is applied.

Hereinafter, in the recording paper 6, a region for forming an image is also referred to as an "image forming region". The shape and size of the image forming region are equal to the shape and size of the transfer region Rt1 shown in FIG. 3. Further, hereinafter, the direction in which the ink ribbon 7 is conveyed for forming an image at the image forming region of the recording paper 6 is also referred to as the "forward conveyance direction". In FIG. 3, the forward conveyance direction is the −X direction.

Note that, in the printing process P, the dye 7*y* is firstly transferred onto the image forming region of the recording paper 6. Thereafter, the dye 7*m*, 7*c*, and the protective material 7*op* are transferred onto the image forming region in order of the dye 7*m*, 7*c*, and the protective material 7*op*. Thus, an image represented by the dyes 7*y*, 7*m*, 7*c* is formed at the image forming region.

Hereinafter, the dye 7*y* is also referred to as the "transferred material ma1". Further, hereinafter, the dye 7*rn* is also referred to as the "transferred material mb2". Still further, hereinafter, the dye 7*c* is also referred to as the "transferred material mb3". Still further, hereinafter, the protective material 7*op* is also referred to as the "transferred material mb4".

In the printing process P, onto the image forming region of the recording paper 6, the transferred materials ma1, mb2, mb3, mb4 are transferred in order of the transferred materials ma1, mb2, mb3, mb4. Hereinafter, each of the transferred materials mb2, mb3, mb4 is also referred to as the "transferred material mb". The transferred material mb is a transferred material that is transferred secondly and later in the printing process P.

Further, the ink ribbon 7 is provided with a plurality of marks MK1*a* and a plurality of marks MK1*s*. The mark MK1*a* is a mark for specifying the position of the transferred material mb. Each of the mark MK1*a* and the mark MK1*s* is, for example, formed by a black-color material.

The mark MK1*a* is provided in association with the transferred material mb. Specifically, the mark MK1*a* is provided at a region on the forward conveyance direction (the −X direction) side relative to the transferred material mb in the ink ribbon 7, so that the mark MK1*a* becomes adjacent to the transferred material mb. Here, it is assumed that the transferred material mb is the dye 7*m* (the transferred material mb2). In this case, as shown in FIG. 3, the mark MK1*a* is provided at a region on the forward conveyance direction (the −X direction) side relative to the dye 7*m* in the ink ribbon 7, so that the mark MK becomes adjacent to the dye 7*m*.

The mark MK1*s* is a mark for specifying the position of the dye 7*y* (the transferred material ma1) being the first transferred material. The mark MK1*s* is provided in association with the dye 7*y*. Specifically, the mark MK1*s* is provided at the region on the forward conveyance direction (−X direction) side relative to the dye 7*y* in the ink ribbon 7, so that the mark MK1*s* becomes adjacent to the dye 7*y*.

With reference again to FIGS. 1 and 2, the thermal printer 100 further includes a conveyance roller pair 13, a platen roller 15, a conveyance unit 40, a sensor SN10, and a cut part Ct1.

Figure 4:
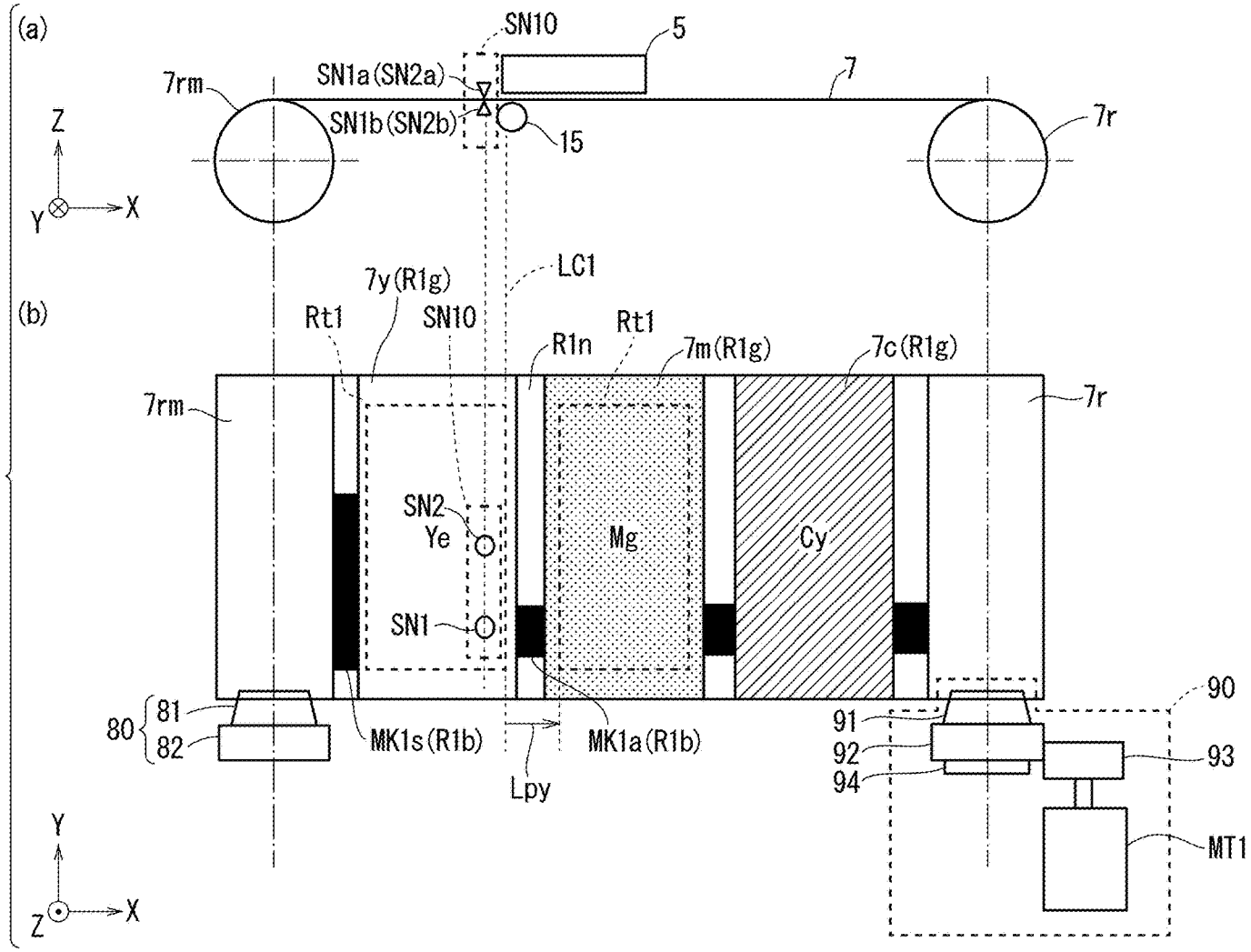
FIG. 4 is a diagram mainly showing a mechanism that conveys the ink ribbon in the thermal printer according to the first embodiment of the present invention.

FIG. 4 is a diagram mainly showing a mechanism that conveys the ink ribbon 7 in the thermal printer 100 according to the first embodiment of the present invention (hereinafter also referred to as the "conveyance mechanism"). Part (a) in FIG. 4 is a side view of the conveyance mechanism. Note that, in part (a) in FIG. 4, for the sake of easier understanding of the conveyance mechanism, part of the constituents (for example, the ink ribbon roll 7*rm*) is shown at a position different from the actual position.

In part (a) in FIG. 4, the X direction, the Y direction, and the Z direction are perpendicular to each other. In the subsequent drawings also, the X direction, the Y direction, and the Z direction are perpendicular to each other. As described above, a direction including the X direction and a direction opposite to the X direction (the —X direction) is also referred to as the "the X-axis direction". Further, as described above, a direction including the Y direction and a direction opposite to the Y direction (the −Y direction) is also referred to as "the Y-axis direction". Hereinafter, a direction including the Z direction and a direction opposite to the Z direction (the −Z direction) is also referred to as "the Z-axis direction".

Further, as described above, a plane including the X-axis direction and the Y-axis direction is also referred to as "the XY-plane". Hereinafter, a plane including the X-axis direction and the Z-axis direction is also referred to as "the XZ-plane". Further, hereinafter, a plane including the Y-axis direction and the Z-axis direction is also referred to as "the YZ-plane". Part (b) in FIG. 4 is a plan view of the conveyance mechanism.

With reference to FIGS. 1, 2, and 4, the conveyance roller pair 13 is a roller pair for conveying the recording paper 6. The conveyance roller pair 13 is structured by a grip roller 13*a* and a pinch roller 13*b*. The grip roller 13*a* rotates by being driven by a rotary driver unit (not shown) such as a motor.

The platen roller 15 is in contact with the recording paper 6 conveyed by the conveyance roller pair 13. The platen roller 15 is provided so as to oppose to part of the thermal head 5.

The conveyance unit 40 is a mechanism for conveying the ink ribbon 7. The conveyance unit 40 is structured by ink conveyance units 80, 90. While details will be described later, the ink conveyance unit 80 conveys the ink ribbon 7 in the forward conveyance direction (the −X direction) in accordance with control of the machine control unit 23.

Hereinafter, an amount by which the ink ribbon 7 is transferred is also referred to as the "conveyance amount". The conveyance amount is also a distance by which the ink ribbon 7 travels. The ink conveyance unit 80 has a function of controlling the conveyance amount of the ink ribbon 7 using an encoder 11 which will be described later.

Hereinafter, a direction opposite to the forward conveyance direction is also referred to as the "reverse conveyance direction". In part (a) in FIG. 4, the reverse conveyance direction is the X direction. While details will be described later, the ink conveyance unit 90 conveys the ink ribbon 7 in the reverse conveyance direction (the X direction) in accordance with the machine control unit 23.

Figure 5:
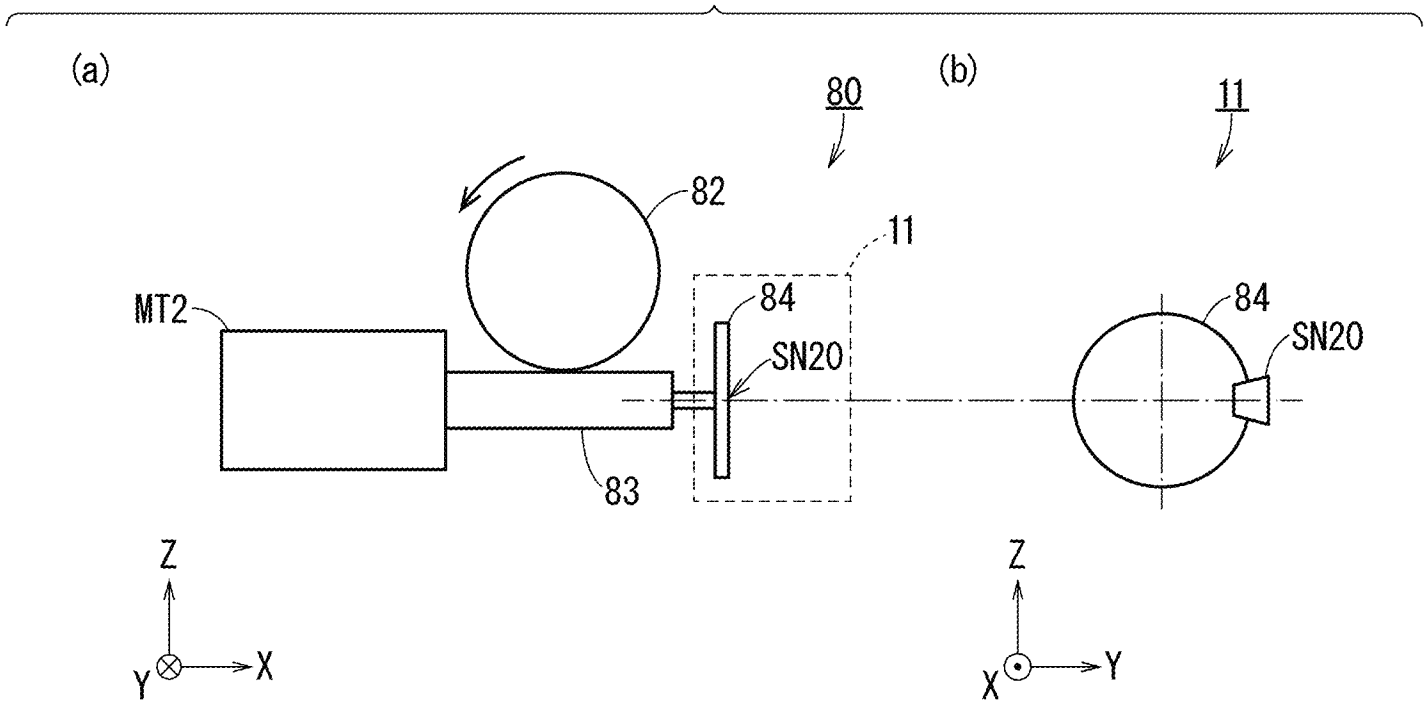
FIG. 5 is a diagram for describing the structure of an ink conveyance unit.

FIG. 5 is a diagram for describing the structure of the ink conveyance unit 80. Part (a) in FIG. 5 is a diagram showing the structure of the ink conveyance unit 80 along the XZ-plane. Part (b) in FIG. 5 is a diagram showing the structure of the encoder 11, which will be described later, included in the ink conveyance unit 80 along the YZ-plane.

With reference to part (b) in FIG. 4 and FIG. 5, the ink conveyance unit 80 includes an attachment 81, a take-up-side gear 82, a motor gear 83, a motor MT2, and the encoder 11.

The attachment 81 is fixed to the side surface of the ink ribbon roll 7*rm*. The motor gear 83 is a bar-like member. On the outer surface of the motor gear 83, a gear is provided. The motor gear 83 is attached to the motor MT2. The motor MT2 causes the motor gear 83 to rotate in accordance with control of the machine control unit 23.

The take-up-side gear 82 is fixed to the attachment 81. Further, the take-up-side gear 82 is provided so as to mesh with the gear at the outer surface of the motor gear 83. Thus, the motor MT2 causes the motor gear 83 to rotate, thereby successfully causing the ink ribbon roll 7*rm* to rotate via the take-up-side gear 82 and the attachment 81.

As necessary, the motor MT2 exerts control for conveying the ink ribbon 7 in the forward conveyance direction (the −X direction). Specifically, the motor MT2 causes the motor gear 83 to rotate so that the take-up-side gear 82 rotates in the counterclockwise direction, thereby causing the ink ribbon roll 7*rm* to rotate in the counterclockwise direction. Thus, the ink ribbon 7 is conveyed in the forward conveyance direction (the −X direction).

Note that, in accordance with the rotation of the ink ribbon roll 7*rm*, the ink ribbon roll 7*r* also rotates so that the tension applied to the ink ribbon 7 is maintained at a constant value. Accordingly, in accordance with the ink ribbon roll 7*rm* taking up part of the ink ribbon 7, the ink ribbon roll 7*r* supplies the ink ribbon 7 by the length of the taken up ink ribbon 7.

The encoder 11 is structured by a rotary member 84 and a sensor SN20. The rotary member 84 is a disc-like member. The rotary member 84 is fixed to an end of the motor gear 83. Thus, the rotary member 84 rotates in accordance with the rotation of the motor gear 83. The rotary member 84 is provided with a not-shown plurality of slits arranged circularly.

The sensor SN20 has a function of detecting each of the slits of the rotating rotary member 84. Every time the sensor SN20 detects the slit of the rotary member 84, the sensor SN20 transmits a pulse (signal) to the control unit 21 via the machine control unit 23.

Next, a description will be given of the ink conveyance unit 90. With reference to part (b) in FIG. 4, the ink conveyance unit 90 includes an attachment 91, a supply-side gear 92, a motor gear 93, a torque limiter 94, and a motor MT1.

The attachment 91 is fixed to the side surface of the ink ribbon roll 7*r*. The supply-side gear 92 is fixed to the attachment 91. Note that, to the supply-side gear 92, the torque limiter 94 for adjusting the rotary force (torque) of the ink ribbon roll 7*r* is provided. A gear is provided at the side surface of the supply-side gear 92.

The motor gear 93 is attached to the motor MT1. The motor gear 93 is provided so as to mesh with the gear at the side surface of the supply-side gear 92. The motor MT1 causes the motor gear 93 to rotate in accordance with control of the machine control unit 23. The motor MT1 causes the motor gear 93 to rotate, thereby successfully causing the ink ribbon roll 7*r* to rotate via the supply-side gear 92 and the attachment 91.

As necessary, the motor MT1 exerts control for conveying the ink ribbon 7 in the reverse conveyance direction (the X direction). Specifically, the motor MT1 causes the motor gear 93 to rotate so that the supply-side gear 92 (the ink ribbon roll 7*r*) rotates in the clockwise direction. Thus, the ink ribbon 7 is conveyed in the reverse conveyance direction (the X direction). That is, the operation of the motor MT1 allows the ink ribbon roll 7*rm* to take up the ink ribbon 7. Note that, in accordance with the rotation of the ink ribbon roll 7*r*, the ink ribbon roll 7*rm* also rotates. Hereinafter, the path along which the ink ribbon 7 is conveyed is also referred to as the "conveyance path".

Next, a description will be given of the sensor SN10. The sensor SN10 has a function of detecting the mark MK1*a* and the mark MK1*s* while the ink ribbon 7 is being conveyed by the conveyance unit 40. The sensor SN10 is provided upstream to the thermal head 5 in the conveyance path along which the ink ribbon 7 is conveyed.

The sensor SN10 has a function of measuring the light transmittance of the ink ribbon 7 using light. In other words, the sensor SN10 has a function of detecting the mark MK1*a* and the mark MK1*s* using the light transmittance of the ink ribbon 7.

The sensor SN10 is structured by a sensor SN1 and a sensor SN2. The sensor SN1 is identical to the sensor SN2 in the structure and the function.

The sensor SN1 has a function of detecting the mark MK1*a* and the mark MK1*s*. That is, the mark MK1*s* is provided at a region in the ink ribbon 7 to be detected by both of the sensor SN1 and the sensor SN2. That is, the length in the Y-axis direction of the mark MK1*s* is greater than the length in the Y-axis direction of the mark MK1*a*, so as to be capable of being detected by both of the sensor SN1 and the sensor SN2.

The sensor SN2 has a function of detecting the mark MK1*s*.

Further, each of the sensor SN1 and the sensor SN2 has a function of measuring the light transmittance of the ink ribbon 7 using light. The sensor SN1 is structured by a light emission unit SN1*a* and a light reception unit SN1*b*. The light emission unit SN1*a* and the light reception unit SN1*b* are provided so that the ink ribbon 7 is interposed between them.

Further, the sensor SN2 is structured by a light emission unit SN2*a* and a light reception unit SN2*b*. The light emission unit SN2*a* and the light reception unit SN2*b* are provided so that the ink ribbon 7 is interposed between them. The light emission unit SN2*a* and the light reception unit SN2*b* are identical in function to the light emission unit SN1*a* and the light reception unit SN1*b*, respectively.

Hereinafter, a region where the sensors SN1, SN2 are provided is also referred to as the "sensor region". The sensor region is, for example in part (b) in FIG. 4, a region where each of the sensors SN1, SN2 are provided. Further, hereinafter, light emitted by the light emission unit SN1*a* of the sensor SN1, or light emitted by the light emission unit SN2*a* of the sensor SN2 is also referred to as the "sensor light".

Further, hereinafter, in the ink ribbon 7, a region where one of the color dye and the protective material lop is applied is also referred to as the "transferred material region R1g". The color dye is one of the dyes 7y, 7m, 7c.

Further, hereinafter, in the ink ribbon 7, a region where one of the marks MK1a, MK1s is provided is also referred to as the "mark region R1b". Still further, hereinafter, in the ink ribbon 7, a region other than the transferred material region R1g and the mark region R1b is also referred to as the "blank region R1n". The blank region R1n is, for example, a transparent region. Still further, hereinafter, the ratio of the quantity of light received by the light reception unit SN1b to the quantity of light emitted by the light emission unit SN1a is also referred to as the "light transmittance" or the "light transmittance Tr".

Next, a description will be given of a process performed by the sensor SN1 (hereinafter also referred to as the "sensor process"). In the sensor process, the light emission unit SN1a emits light toward the ink ribbon 7. The light reception unit SN1b receives, out of the light emitted by the light emission unit SN1a, light having transmitted through one of the transferred material region R1g, the mark region R1b, and the blank region R1n included in the ink ribbon 7.

Further, in the sensor process, the light reception unit SN1b calculates the light transmittance, which is the ratio of the quantity of light received by the light reception unit SN1b to the quantity of light emitted by the light emission unit SN1a. By the foregoing method, the sensor SN1 constantly measures the light transmittance.

Still further, in the sensor process, the sensor SN1 is constantly transmitting a detection signal to the control unit 21 via the machine control unit 23. In the sensor process, when the latest light transmittance is less than a threshold value Th1, the sensor SN1 sets the level of the detection signal to the L-level. The threshold value Th1 is a value for detecting the marks MK1a, MK1s. The threshold value Th1 is a value that falls within, for example, a range of values 0.01 times to 0.2 times as great as the light transmittance of the blank region R1n.

For example, when there exists, between the light reception unit SN1b and the light emission unit SN1a, the mark region R1b provided with one of the marks MK1a, MK1s, the light reception unit SN1b determines that the latest light transmittance is less than the threshold value Th1. By the latest light transmittance becoming less than the threshold value Th1, the sensor SN1 detects one of the marks MK1a, MK1s.

The sensor SN1 sets the level of the detection signal to the L-level over the period in which one of the marks MK1a, MK1s is being detected. Further, when the latest light transmittance is equal to or greater than the threshold value Th1, the sensor SN1 sets the level of the detection signal to the H-level.

Note that, as described above, the sensor SN1 is identical to the sensor SN2 in the structure and the function. Accordingly, the operation and the structure of the sensor SN2 (the light emission unit SN2a and the light reception unit SN2b) are similar to those of the sensor SN1 (the light emission unit SN1a and the light reception unit SN1b) and, therefore, a detailed description thereof is not repeated.

That is, similarly to the sensor SN1, the sensor SN2 performs the sensor process. That is, the light emission unit SN2a and the light reception unit SN2b perform the sensor process similarly to the light emission unit SN1a and the light reception unit SN1b.

Hereinafter, the position where the thermal head 5 emits heat (a heater line) is also referred to as the "heating position LC1". The heating position LC1 is, for example, the position shown in FIG. 4. Note that, as described above, the sensor SN10 is provided at the position upstream to the thermal head 5 in the conveyance path along which the ink ribbon 7 is conveyed. That is, the sensor SN10 (the sensors SN1, SN2) is provided at a position upstream to the heating position LC1 (the heater line) in the conveyance path along which the ink ribbon 7 is conveyed.

Hereinafter, the direction in which the recording paper 6 is conveyed is also referred to as the "paper conveyance direction". Further, hereinafter, the length in the paper conveyance direction of the above-described image forming region in the recording paper 6 is also referred to as the "transfer length Lsp". Still further, the direction in which the ink ribbon 7 is conveyed is also referred to as the "ribbon conveyance direction". The ribbon conveyance direction is the X-axis direction including the above-described forward conveyance direction (the −X direction) and reverse conveyance direction (the X direction). Still further, the length in the ribbon conveyance direction (X-axis direction) of the transfer region Rt1 in the ink ribbon 7 is also referred to as the "transfer length Lsa". The transfer length Lsa is the same as the transfer length Lsp.

Hereinafter, a direction in which the recording paper 6 is conveyed for forming an image at the image forming region of the recording paper 6 is also referred to as the "paper forward conveyance direction". In part (b) in FIG. 4, the paper forward conveyance direction is the −X direction. Further, hereinafter, the direction opposite to the paper forward conveyance direction is also referred to as the "paper reverse conveyance direction". The paper reverse conveyance direction is a direction in which the recording paper 6 travels toward the ejection side. In part (b) in FIG. 4, the paper reverse conveyance direction is the X direction.

Next, a brief description will be given of the printing process P. The printing process P is a process of transferring the first to fourth transferred materials in order onto the image forming region of the recording paper 6. The first to fourth transferred materials are the dyes 7y, 7m, 7c, and the protective material lop, respectively. Note that, for the sake of brevity, immediately before the printing process P is performed, it is assumed that the position of the leading end of the image forming region of the recording paper 6 and the position of the leading end of the transfer region Rt1 in the first transferred material in the ink ribbon 7 are each at the heating position LC1.

Hereinafter, the state of the platen roller 15 being in contact with the thermal head 5 via the recording paper 6 and the ink ribbon 7 is also referred to as the "platen contact state". Further, hereinafter, the state of the platen roller 15 being spaced apart from the recording paper 6 is also referred to as the "platen non-contact state". The printing process P is performed in the situation where the platen roller 15 is in the platen contact state.

In the printing process P, a unit printing process is performed. In the unit printing process, a ribbon conveyance process, a paper conveyance process, and a transfer process are performed simultaneously. Note that, the following ribbon conveyance process, paper conveyance process, and transfer process are performed in the state where, as a result of the ink ribbon 7 being conveyed by control of the control unit 21, the heater line (the heating position LC1) is at the position of the leading end of the transfer region Rt1 in the transferred material. The leading end of the transfer region Rt1 is, for example, the left end in the X-axis direction of the transfer region Rt1 in the dye 7y in part (b) in FIG. 4.

In the ribbon conveyance process, the ink ribbon 7 is unreeled from the ink ribbon roll 7*r* by a transfer length Lsa. Thus, the ink ribbon 7 is conveyed over a predetermined time. Note that, in the ribbon conveyance process, in the state where the ink ribbon 7 is in contact with the thermal head 5, the conveyance unit 40 conveys the ink ribbon 7 in the forward conveyance direction (the −X direction).

Further, in the paper conveyance process, the recording paper 6 is conveyed by the conveyance roller pair 13. Specifically, by the conveyance roller pair 13, the recording paper 6 is unreeled from the roll paper 6*r* by a transfer length Lsp. Thus, the recording paper 6 is conveyed over a predetermined time as being interposed in the conveyance roller pair 13.

In the transfer process, over the period in which the ink ribbon 7 and the recording paper 6 are conveyed, the thermal head 5 heats a u-th transferred material at the heating position LC1. Herein, "u" is a natural number equal to or greater than 1. When the transfer process is firstly performed, u is 1. Note that, the quantity of heat applied by the thermal head 5 is controlled by the printing control unit 22 based on the above-described print data. Thus, the transferred material of the ink ribbon 7 is transferred onto the image forming region of the recording paper 6.

Then, the ink ribbon 7 is taken up by the ink ribbon roll 7*rm*, so that the position of the leading end of the transfer region Rt1 in the next transferred material is set to the heating position LC1. Further, the recording paper 6 is taken up by the roll paper 6*r* so that the position of the leading end of the image forming region in the recording paper 6 is set to the heating position LC1.

The foregoing unit printing process is performed similarly as to each of the second to fourth transferred materials. Then, the printing process P ends. Thus, on the image forming region, the dyes 7*y*, 7*m*, 7*c* and the protective material 7*op* are transferred in order of the dyes 7*y*, 7*m*, 7*c* and the protective material 7*op*. Thus, an image is formed at the image forming region. Hereinafter, the recording paper 6 having an image formed at its image forming region is also referred to as the "printed article". The printed article is part of the recording paper 6.

Then, the recording paper 6 is conveyed by a predetermined length, and cut to have a predetermined dimension by the cut part Ct1. Thus, the printed article being part of the recording paper 6 is produced. Further, by an ejection mechanism (not shown), the printed article is ejected from the thermal printer 100.

Next, a detailed description will be given of the structure of the ink ribbon 7. Hereinafter, a portion on the back side of the ink ribbon 7 is also referred to as the "back surface part 70*r*". The ink ribbon 7 includes the back surface part 70*r*.

Figure 6:
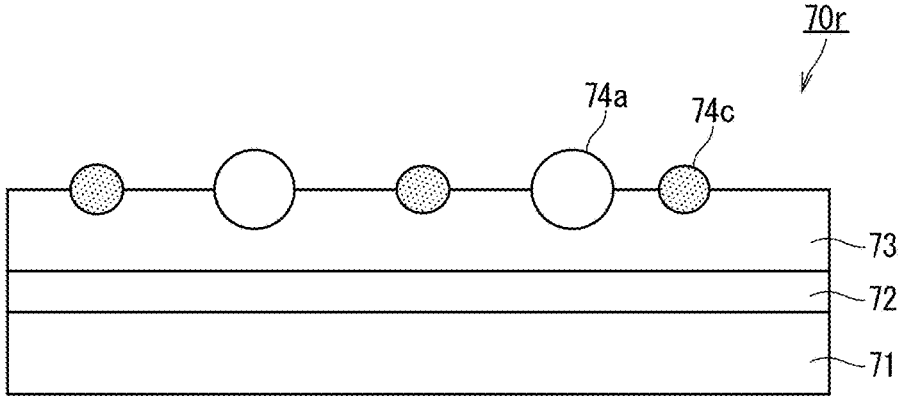
FIG. 6 is a section view of a back surface part included in the ink ribbon.

FIG. 6 is a section view of the back surface part 70*r* included in the ink ribbon 7. The upper surface of the back surface part 70*r* is the surface brought into contact with the thermal head 5 when the printing process P is performed. Note that, below the back surface part 70*r*, a not-shown transferred material (for example, the dye 7*y*) is provided.

With reference to FIG. 6, the back surface part 70*r* includes a substrate layer 71, a primer layer 72, and a binder layer 73. The binder layer 73 is formed by resin. To the front surface (the upper surface) of the binder layer 73, a plurality of lubricating components 74*a* and a plurality of cleaning components 74*c* are applied. The front surface of the binder layer 73 is the back surface of the ink ribbon 7.

In a normal temperature environment, the lubricating components 74*a* are solid. The normal temperature environment is, for example, an environment where the temperature is less than 40 degrees. By the thermal head 5 heating the lubricating components 74*a*, the lubricating components 74*a* are molten. The lubricating components 74*a* are characterized in that the meltage thereof becomes greater as the quantity of heat applied to the lubricating components 74*a* is greater. The lubricating components 74*a* are a material that functions as, for example, a lubricant. The cleaning components 74*c* are, for example, talc.

Hereinafter, the state where the ink ribbon 7 being conveyed is in contact with the thermal head 5 is also referred to as the "ribbon contact state". Further, hereinafter, in the ribbon contact state, friction generated between the thermal head 5 and the ink ribbon 7 is also referred to as the "head friction". Still further, hereinafter, a coefficient based on the head friction is also referred to as the "friction coefficient Fc" or "Fe". The head friction is greater as a value of friction coefficient Fc is greater.

Note that, when the lubricating components 74*a* are heated by the thermal head 5 and molten, the head friction becomes small. Further, when the lubricating components 74*a* are molten, the cleaning components 74*c* prevent fragments occurring at the upper surface of the back surface part 70*r* from attaching to the thermal head 5.

Hereinafter, an image to be formed on the recording paper 6 by the printing process P is also referred to as the "subject image". Further, hereinafter, each of the value of a plurality of pixels forming the subject image is also referred to as the "print density Dn" or "Dn".

Hereinafter, the maximum heat quantity in a range where the transferred material does not sublime is also referred to as the "heat quantity Hq0". The heat quantity Hq0 is a heat quantity with which a color dye does not sublime when heat of the heat quantity Hq0 is applied to the color dye in the above-described transfer process. The color dye is one of the dyes 7*y*, 7*m*, 7*c*.

Figure 7:
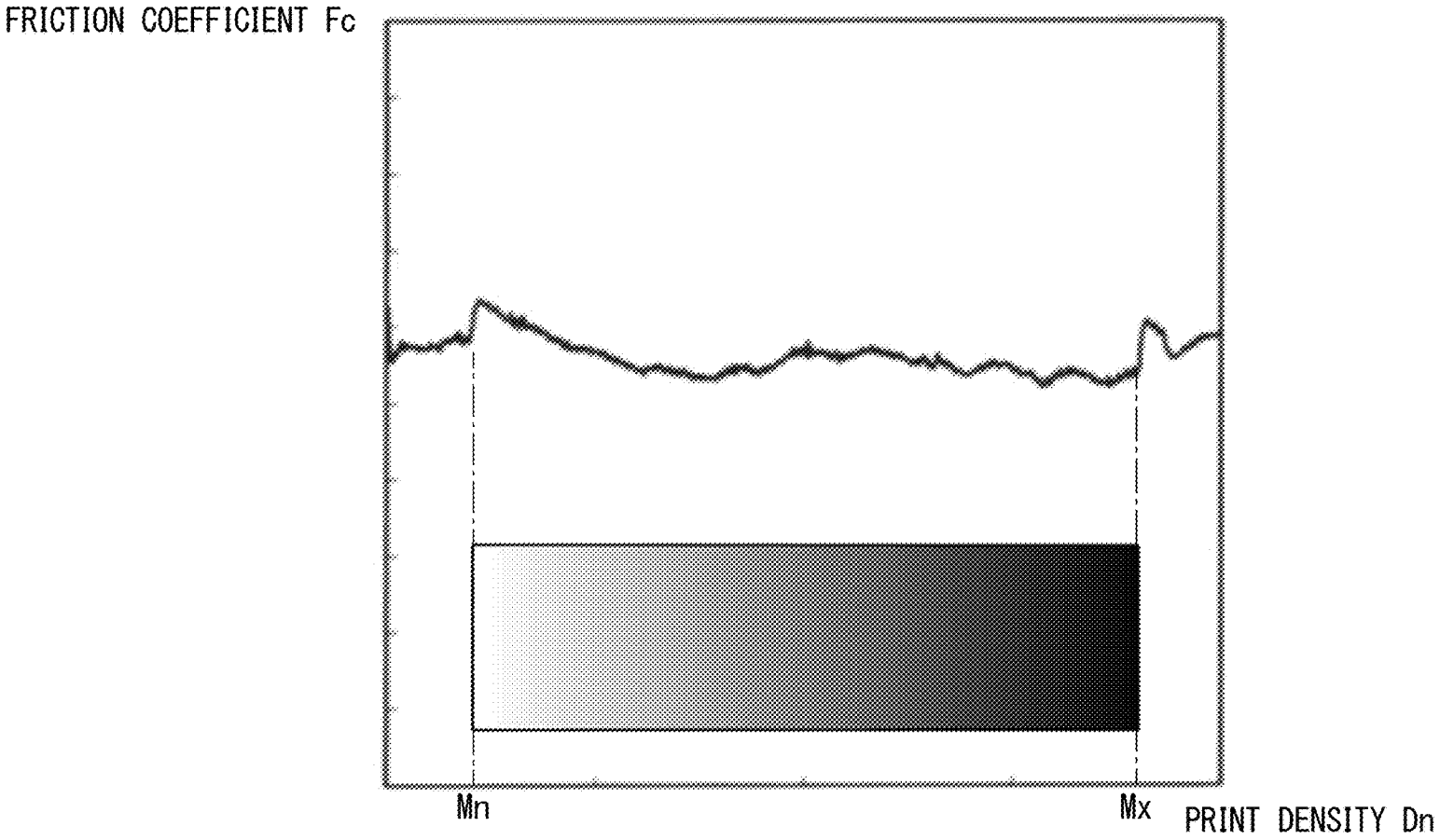
FIG. 7 is a diagram showing the relationship between a friction coefficient and a print density.

FIG. 7 is a diagram showing the relationship between the friction coefficient Fc and the print density Dn. In FIG. 7, the vertical axis indicates the friction coefficient Fc. The horizontal axis indicates the print density Dn. As an example, the print density Dn is represented by a numerical value of 8 bits. That is, the print density Dn is represented by 0 to 255. In this case, the minimum value Mn of the print density Dn is 0. The maximum value Mx of the print density Dn is 255. The print density Dn that represents the minimum value Mn is the density that corresponds to the heat quantity Hq0.

As shown in FIG. 7, the magnitude of the head friction differs depending on the magnitude of the print density Dn. Specifically, as the print density Dn is closer to the minimum value Mn, the value of the friction coefficient Fc is greater. That is, as the print density Dn is closer to the minimum value Mn, the head friction is greater.

The meltage of the lubricating components 74*a* is very small in the case where heat of the heat quantity Hq0 corresponding to the print density at representing the minimum value Mn is applied to the ink ribbon 7. Accordingly, the head friction is great in the state where heat of the heat quantity Hq0 is applied to the ink ribbon 7. In this case, by the ink ribbon 7 being conveyed while being in contact with the thermal head 5, any attached substance existing on the thermal head 5 can be removed. Thus, cleaning of the thermal head 5 can be performed. The attached substance is, for example, fragments of the ink ribbon 7 occurring from the past printing process P. Further, the attached substance is, for example, dust, waste or the like.

Figure 8:
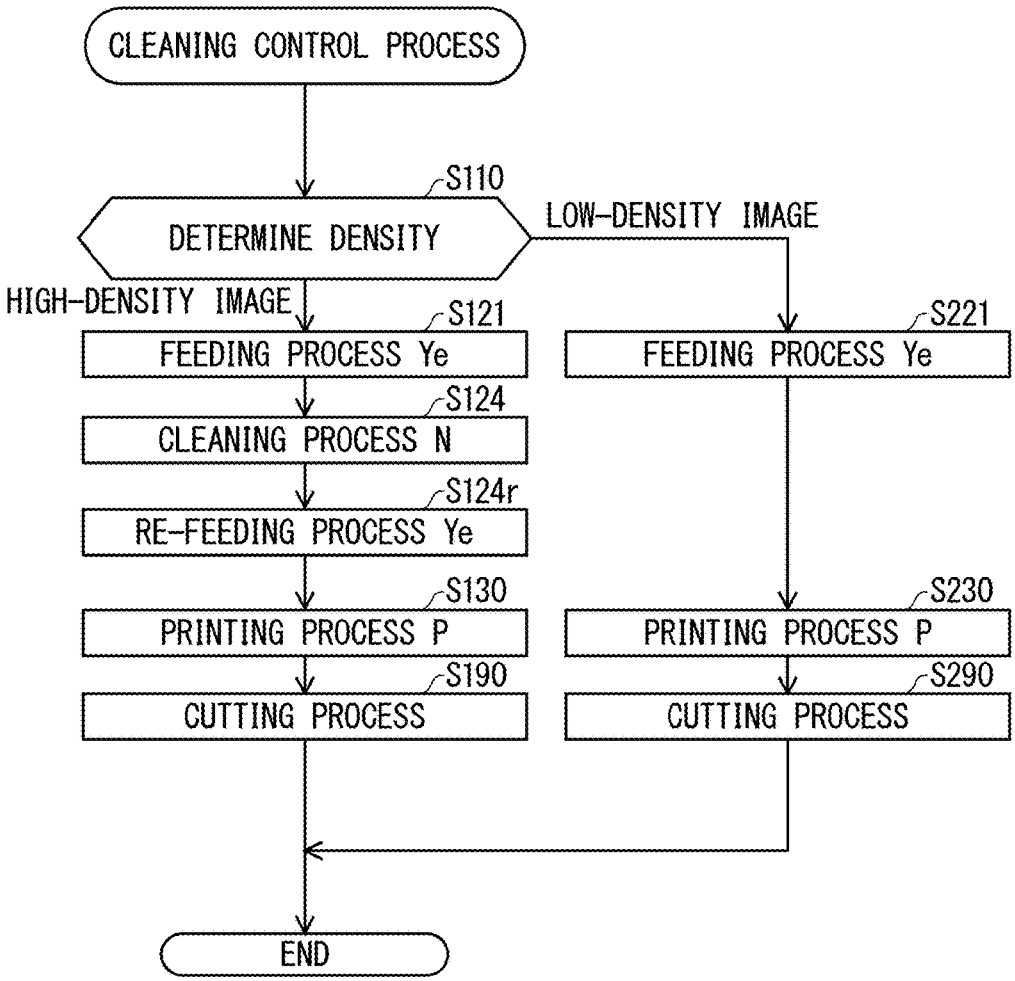
FIG. 8 is a flowchart of a cleaning control process according to the first embodiment of the present invention.

Next, a description will be given of a process performed by the thermal printer 100 (hereinafter also referred to as the "cleaning control process"). FIG. 8 is a flowchart of the cleaning control process according to the first embodiment of the present invention. When the thermal printer 100 receives the print instruction and the image data D1 from the information processing apparatus 200, the cleaning control process is executed.

Hereinafter, an image represented by the image data D1 is also referred to as the "subject image". As described above, the subject image is an image to be formed on the recording paper 6. The subject image is formed by a plurality of pixels. In the present embodiment, the subject image is classified into a high-density image and a low-density image.

Hereinafter, the density of the subject image is also referred to as the "image density". The image density is, as an example, the average value of the values of a plurality of pixels forming the subject image.

In Step S110, a density determination is made. Firstly, the calculation unit 21*a* of the control unit 21 calculates the image density of the subject image. Then, the control unit 21 determines whether or not the image density is greater than a predetermined reference density. The reference density is, for example, a value about 0.5 times as great as the maximum value Mx of the above-described print density Dn.

Here, it is assumed that each of the pixels of the subject image is expressed by a value from 0 to 255. In this case, the maximum value Mx is 255, and the reference density is, for example, 127. Note that, the reference density is not limited to, for example, a value about 0.5 times as great as the maximum value Mx. For example, the reference density may be a value included in a range from a value 0.3 times to 0.7 times as great as the maximum value Mx.

When the image density is greater than the reference density, the control unit 21 determines that the subject image is a high-density image, and the process transits to Step S121. On the other hand, when the image density is equal to or smaller than the reference density, the control unit 21 determines that the subject image is a low-density image, and the process transits to Step S221 which will be described later.

Hereinafter, the position where the above-described transfer process is performed on the transferred material is also referred to as the "printing start position".

In Step S121, a feeding process Ye is performed. In the feeding process Ye, the feeding of the dye 7*y* is performed. Specifically, in the feeding process Ye, the conveyance unit 40 conveys the ink ribbon 7 so that the position of the dye 7*y* is set to the printing start position. The conveyance of the ink ribbon 7 by the conveyance unit 40 is performed based on the detection state of the mark MK1*s* of the sensor SN10 (the sensors SN1, SN2).

In Step S124, a cleaning process N is performed. The cleaning process N is a process of performing cleaning of the thermal head 5. The cleaning process N is performed using the entire transfer region Rt1 of the transferred material (the dye 7*y*). That is, the thermal printer performs the cleaning process N using the entire transfer region Rt1 of the ink ribbon 7.

In the cleaning process N, the state of the platen roller 15 is set to the above-described platen contact state. Next, the above-described ribbon conveyance process, the above-described paper conveyance process and a transfer process N are simultaneously performed as to the dye 7*y*.

In the ribbon conveyance process, the ink ribbon 7 conveys the ink ribbon 7 in the forward conveyance direction (the −X direction) while the conveyance unit 40 is in contact with the thermal head 5.

In the transfer process N, over the period in which the ink ribbon 7 and the recording paper 6 is conveyed, the thermal head 5 applies heat of the above-described heat quantity Hq0 to the ink ribbon 7 in accordance with control of the printing control unit 22. As described above, the heat quantity Hq0 is the heat quantity with which the color dye (for example, the dye 7*y*) does not sublime. Specifically, in the transfer process N, the thermal head 5 applies heat of the heat quantity Hq0 to the entire transfer region Rt1 of the dye 7*y*. As described above, the head friction is great in the state where the heat of the heat quantity Hq0 is applied to the ink ribbon 7.

By the ribbon conveyance process and the transfer process N, the above-described attached substance existing on the thermal head 5 can be removed. That is, cleaning of the thermal head 5 can be performed with the ink ribbon 7. Accordingly, the above-described heat quantity Hq0 is the heat quantity for performing cleaning of the thermal head 5. Thus, the ink ribbon 7 has a function of performing cleaning of the thermal head 5 by being heated.

In Step S124*r*, a re-feeding process Ye is performed. In the re-feeding process Ye, the state of the platen roller 15 is set to the above-described platen non-contact state. Next, in order for the dye 7*y* to be fed, the ink ribbon 7 is rewound. Specifically, as seen in a plan view (the XY-plane), the conveyance unit 40 conveys the ink ribbon 7 in the reverse conveyance direction (the X direction) so that the position of the sensor SN10 is set to the position on the forward conveyance direction (−X direction) side relative to the mark MK1*s* corresponding to the dye 7*y*.

Further, the conveyance roller pair 13 conveys the recording paper 6 in the paper reverse conveyance direction (X direction) by the shift amount of the ink ribbon 7. Next, the above-described feeding process Ye is performed. Thus, the feeding of the dye 7*y* is performed.

In Step S130, the above-described printing process P is performed. Note that, before the printing process P is performed, the state of the platen roller 15 is set to the above-described platen contact state. By the printing process P, the dyes 7*y*, 7*m*, 7*c* and the protective material lop are transferred in order onto the image forming region of the recording paper 6. Thus, the above-described printed article is produced at the end of the recording paper 6.

In Step S190, a cutting process is performed. In the cutting process, the recording paper 6 including the printed article is conveyed by a predetermined length. Then, the cut part Ct1 cuts the recording paper 6 so that the printed article is separated from the recording paper 6. Then, by the ejection mechanism (not shown), the printed article is ejected from the thermal printer 100. Thus, the cleaning control process ends.

Note that, when it is determined that the subject image is a low-density image in Step S110, the process transits to Step S221. In Step S221, similarly to Step S121, the above-described feeding process Ye is performed. Then, the above-described printing process P (S230) and the above-described cutting process (S290) are performed.

Thus, when the subject image is a low-density image, the cleaning process N is not performed. That is, in the cleaning control process, when the image density is greater than the reference density, the thermal printer 100 performs the cleaning process N. Further, in the cleaning control process, the thermal printer 100 performs the cleaning process N before performing the printing process P.

As has been described above, according to the present embodiment, the thermal printer 100 uses the ink ribbon 7 having a function of cleaning the thermal head 5 by being heated. The thermal printer 100 performs the cleaning process N of cleaning the thermal head 5. In the cleaning process N, the thermal head 5 applies, to the ink ribbon 7, heat of a heat quantity with which heat quantity the dye 7*y* applied onto the ink ribbon 7 does not sublime and with which cleaning is performed. Thus, without the necessity of using a cassette head cleaner, cleaning of the thermal head can be performed.

Further, according to the present embodiment, cleaning of the thermal head 5 is performed using the back surface of the ink ribbon 7. Accordingly, cleaning of the thermal head 5 can be performed without the necessity of attaching a cassette head cleaner including a cleaning sheet to the thermal printer.

Note that, while the above-described density determination is a method of comparing the average value of the values of a plurality of pixels forming an image against the reference density, the present invention is not limited thereto. The density determination may be made according to other method so long as the cleaning effect is expected.

In the density determination, for example, whether or not the subject image is an image having a specific density distribution may be determined. Further, in the density determination, for example, whether or not the subject image is an image having a high-density region in the extending direction of the thermal head 5 may be determined.

Further, while the region used in the cleaning process according to the present embodiment is the transfer region Rt1 of the dye 7*y*, the present invention is not limited thereto. The region used in the cleaning process may be the transfer region Rt1 of the dye 7*m*, the transfer region Rt1 of the dye 7*c*, the transfer region Rt1 of the protective material 7*op* or the like.

Still further, the region used in the cleaning process may be all of the transfer regions Rt1 of the four transferred materials (the dyes 7*y*, 7*m*, 7*c* and the protective material 7*op*), respectively. Further, the cleaning process may be repeatedly performed using the transfer region Rt1 of each of the transferred materials.

Still further, while the thermal printer 100 makes the density determination in the present embodiment, the present invention is not limited thereto. An apparatus other than the thermal printer 100 may perform the density determination so long as the apparatus is capable of processing image data. For example, the information processing apparatus 200 may make the density determination. In this case, the information processing apparatus 200 may make the density determination, and inform the thermal printer 100 whether or not execution of the cleaning process is necessary.

In the following, the reason why the density determination is made in the above-described manner is described. In the case where a process of printing a high-density image is performed, the meltage of the lubricating components 74*a* on the back surface of the ink ribbon 7 is great. In this case, the molten lubricating components 74*a* may be highly likely to attach to the thermal head 5 as fragments (an attached substance). In particular, when the distribution state of the lubricating components 74*a* and the cleaning components 74*c* deviates from the desired distribution state due to manufacturing variations of the ink ribbon or the like, the cleaning components 74*c* may fail to completely remove the fragments.

Note that, in the case where a process of printing a low-density image is performed, the meltage of the lubricating components 74*a* on the back surface of the ink ribbon 7 is small. Accordingly, in the case where the process of printing a low-density image is performed, the cleaning effect is fully exhibited.

In the present embodiment, when the subject image is a high-density image, the cleaning process N is performed. In the cleaning process N, the conveyance unit 40 conveys the ink ribbon 7 in the forward conveyance direction while the ink ribbon 7 is in contact with the thermal head 5. Thereafter, the conveyance unit 40 conveys the ink ribbon 7 in the reverse conveyance direction. When the process of conveying the ink ribbon 7 in the reverse conveyance direction is performed, the time taken for the printing increases. On the other hand, by the cleaning process N being performed, cleaning of the thermal head 5 can be effectively performed using the entire transfer region Rt1 of the transferred material (the dye 7*y*).

Further, in the present embodiment, the cleaning process N is performed in the case where the subject image is a high-density image. Accordingly, an increase in time taken for a printing process can be minimized. Further, in the case where the fragments of the ink ribbon are attached to the thermal head 5 due to manufacturing variations of the ink ribbon or the like also, cleaning of the thermal head 5 can be surely executed.

Thus, in the present embodiment, in the case where cleaning of the thermal head 5 is required, the cleaning of the thermal head 5 can be performed without the necessity of attaching a dedicated cleaning cassette including a cleaning sheet to the thermal printer 100 as in the conventional case. Accordingly, the present embodiment can save users' time and trouble in maintenance of the thermal head 5. Further, high-quality printing can be performed. Accordingly, a high-quality printed article free from scratches due to an ink fragments, waste or the like can be obtained.

Note that, the related structure A suffers from a problem that it necessitates the trouble of, every time cleaning of the thermal head 5 is required, removing the ink ribbon from the thermal printer and thereafter attaching the cassette head cleaner to the thermal printer.

Therefore, the thermal printer 100 according to the present embodiment is structured as described above. Accordingly, the thermal printer 100 according to the present embodiment can solve the above-described problem.

Second Embodiment

Hereinafter, the region in the ink ribbon 7 other than the transfer region Rt1 is also referred to as the "non-transfer region".

In the structure of the present embodiment, cleaning is performed using a non-transfer region (hereinafter also referred to as the "structure CtA"). The thermal printer in the structure CtA is the thermal printer 100.

Figure 9:
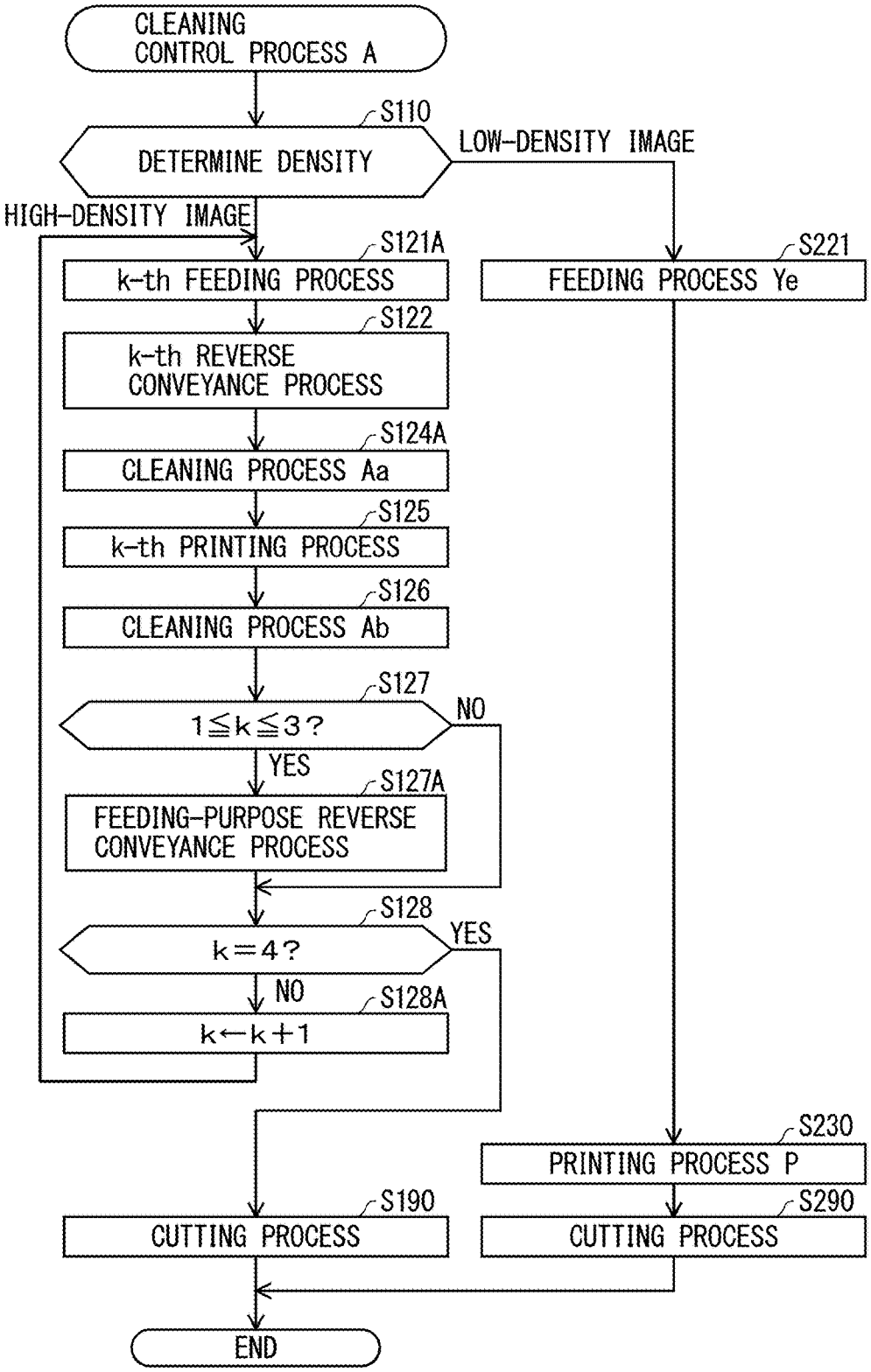
FIG. 9 is a flowchart of a cleaning control process A according to a second embodiment of the present invention.

Next, a description will be given of a process performed by the thermal printer 100 to which the structure CtA is applied (hereinafter also referred to as the "cleaning control process A"). FIG. 9 is a flowchart of the cleaning control process A according to a second embodiment of the present invention.

Figure 10:
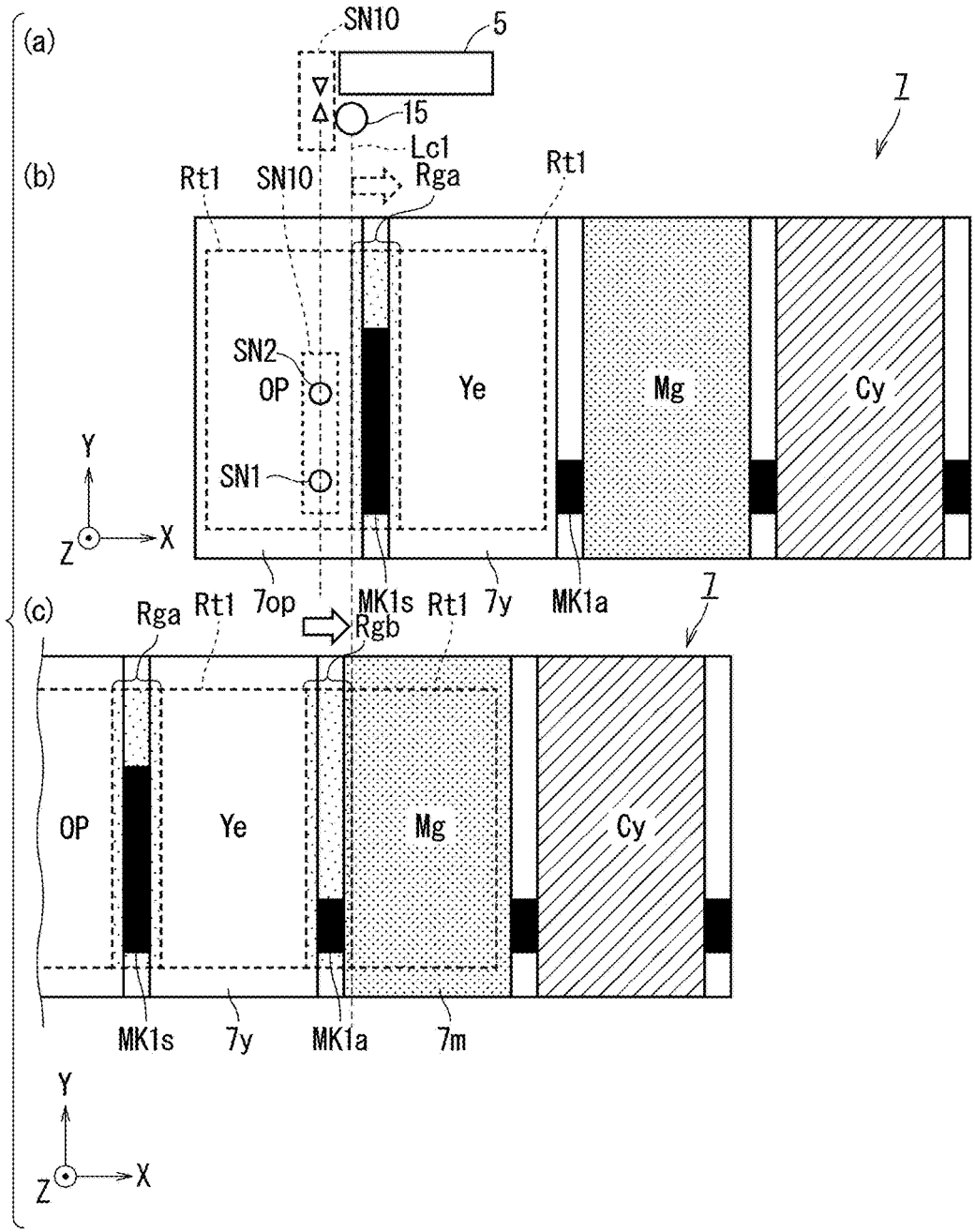
FIG. 10 is a diagram for describing part of the cleaning control process A according to the second embodiment of the present invention.

When the thermal printer 100 receives a print instruction and image data D1 from the information processing apparatus 200, the cleaning control process A is executed. FIG. 10 is a diagram for describing part of the cleaning control process A according to the second embodiment of the present invention. Part (a) in FIG. 10 is a diagram mainly showing the thermal head 5 and the sensor SN10. Part (b) in FIG. 10 and part (c) in FIG. 10 are each a plan view for describing part of the cleaning control process A.

In FIG. 9, a process denoted by the step number identical to that in FIG. 8 is the process identical to that described in the first embodiment and, therefore, a detailed description thereof will not be repeated. In the following, a description will be given mainly of the difference from the first embodiment.

In the cleaning control process A, similarly to the first embodiment, the process of Step S110 is performed. When the subject image is a high-density image, the process transits to Step S121A.

In Step S121A, a k-th feeding process is performed. "k" is a natural number. The initial value of k is 1. In the k-th feeding process, feeding of a k-th transferred material is performed. When k is 1, the k-th transferred material is the dye 7*y*. In this case, feeding of the dye 7*y* being the first transferred material is performed.

That is, when k is 1, in the k-th feeding process, a process identical to the feeding process Ye in Step S121 in FIG. 8 is performed. Thus, the position of the leading end (the left end) of the transfer region Rt1 of the dye 7*y* is set to the heating position LC1.

In the present embodiment, cleaning is performed using regions Rga, Rgb. The region Rga is a region between two transfer regions Rt1 respectively included in adjacent two transferred materials in the ink ribbon 7. Each of the regions Rga, Rgb is a region not used for printing.

For example, as shown in FIG. 3 and part (b) in FIG. 10, the region Rga is the region between the transfer region Rt1 of the protective material lop and the transfer region Rt1 of the dye 7*y* in the ink ribbon 7. The region Rga is adjacent to the transfer region Rt1 of the k-th transferred material in the forward conveyance direction (the −X direction). Note that, the region Rga adjacent to the transfer region Rt1 of the dye 7*y* includes the mark MK1*s*. The region Rgb adjacent to the transfer region Rt1 of the dye 7*y* includes the mark MK1*a*.

As shown in part (c) in FIG. 10, the region Rgb is the region between the transfer region Rt1 of the dye 7*y* and the transfer region Rt1 of the dye 7*m* in the ink ribbon 7. The region Rgb is adjacent to the transfer region Rt1 of the k-th transferred material in the reverse conveyance direction (the X direction). The size of the region Rga is identical to the size of the region Rgb. Hereinafter, the length in the ribbon conveyance direction (the X-axis direction) of each of the region Rga and the region Rgb is also referred to as the "length Lsc".

In Step S122, a k-th reverse conveyance process is performed. The k-th reverse conveyance process is a process of conveying the k-th transferred material in the reverse conveyance direction (the X direction). That is, in the k-th reverse conveyance process, the ink ribbon 7 is rewound. Specifically, in the k-th reverse conveyance process, the conveyance unit 40 conveys the ink ribbon 7 in the reverse conveyance direction (the X direction), so that the leading end (the left end) of the region Rga adjacent to the transfer region Rt1 of the k-th transferred material is set to the heating position LC1.

In Step S124A, a cleaning process Aa is performed. In the cleaning process Aa, firstly, the state of the platen roller 15 is set to the above-described platen contact state. Then, the ribbon conveyance process Aa, the paper conveyance process Aa, and the transfer process Aa are simultaneously performed on the region Rga adjacent to the transfer region Rt1 of the k-th transferred material.

In the ribbon conveyance process Aa, the conveyance unit 40 conveys the ink ribbon 7 in the forward conveyance direction (the −X direction) by the length Lsc while the ink ribbon 7 is in contact with the thermal head 5.

In the paper conveyance process Aa, the conveyance roller pair 13 conveys the recording paper 6 in the paper forward conveyance direction (the −X direction) by the length Lsc.

In the transfer process Aa, over the period in which the ink ribbon 7 and the recording paper 6 are conveyed, the thermal head 5 applies heat of the above-described heat quantity Hq0 to the ink ribbon 7 in accordance with control of the printing control unit 22. Specifically, in the transfer process Aa, the thermal head 5 applies heat of the heat quantity Hq0 to the entire region. Rga.

By the ribbon conveyance process Aa, the paper conveyance process Aa, and the transfer process Aa, cleaning of the thermal head 5 can be performed using the region. Rga of the ink ribbon 7.

In Step S125, a k-th printing process is performed. The k-th printing process is a process of transferring the k-th transferred material onto the image forming region of the recording paper 6. Further, the k-th printing process is also a process of selectively transferring the dyes 7*y*, 7*m*, 7*c* and the protective material lop onto the recording paper 6.

Specifically, in the k-th printing process, the above-described unit printing process is performed as to the k-th transferred material. Thus, the k-th transferred material is transferred onto the image forming region of the recording paper 6. Prior to Step S125, Step S124A (the cleaning process Aa) is performed. That is, the thermal printer 100 performs the cleaning process Aa before performing the k-th printing process.

In Step S126, a cleaning process Ab is performed. In the cleaning process Ab, the above-described ribbon conveyance process Aa, the above-described paper conveyance process Aa, and a transfer process Ab are simultaneously performed on the region Rgb of the ink ribbon 7.

In the transfer process Ab, the thermal head 5 applies heat of the above-described heat quantity Hq0 to the ink ribbon 7 in accordance with control of the printing control unit 22 over the period in which the ink ribbon 7 and the recording paper 6 are conveyed. Specifically, in the transfer process Ab, the thermal head 5 applies heat of the heat quantity Hq0 to the entire region Rgb.

By the ribbon conveyance process Aa, the paper conveyance process Aa, and the transfer process Ab, cleaning of the thermal head 5 can be performed using the region Rgb of the ink ribbon 7.

Next, Step S127 is performed. In Step S127, the control unit 21 determines whether the value of k falls within a range from 1 to 3 inclusive. When YES in Step S127, the process transits to Step S127A. On the other hand, when NO in Step S127, the process transits to Step S128.

Here, it is assumed that k is 1. In this case, at the end point of Step S126, as seen in a plan view (the XY-plane), the sensor SN10 is at a position where the sensor SN10 cannot normally detect the mark MK1*a* corresponding to the second transferred material (the dye 7*m*). Accordingly, the process of the Step S127A is performed.

In Step S127A, a feeding-purpose reverse conveyance process is performed. In the feeding-purpose reverse conveyance process, the ink ribbon 7 is rewound so that feeding of the transferred material subsequent to the k-th transferred material is performed. Specifically, in the feeding-purpose reverse conveyance process, firstly, the state of the platen roller 15 is set to the above-described platen non-contact state. Next, as seen in a plan view (the XY-plane), the conveyance unit 40 conveys the ink ribbon 7 in the reverse conveyance direction (the X direction), so that the position of the sensor SN10 is set on the forward conveyance direction (−X direction) side relative to the mark MK1*a* corresponding to the (k+1)-th transferred material (for example, the dye 7*m*).

In the Step S128, the control unit 21 determines whether or not k is 4. When k is 4, the printing process of the fourth transferred material (the protective material 7*op*) is finished. When YES in Step S128, the process transits to Step S190. On the other hand, when NO in Step S128, the value of k is incremented by 1 (S128A), and again the process of Step S121A is performed.

When k is 2, in Step S121A, a process for feeding the dye 7*m* being the second transferred material is performed. In Step S121A, the conveyance of the ink ribbon 7 by the conveyance unit 40 is performed based on the detection state of the sensor SN10 (the sensors SN1, SN2) as to the mark MK1*a* corresponding to the dye 7*m*.

In the cleaning control process A, the processes from Steps S121A to S128A are repeatedly performed until the determination result is YES in Step S128. Thus, the dyes 7*y*, 7*m*, 7*c*, and the protective material 7*op* are transferred in order onto the image forming region.

Further, before transfer of each of the four transferred materials (the dyes 7*y*, 7*m*, 7*c*, and the protective material 7*op*) is performed, cleaning of the thermal head 5 is performed using the regions Rga, Rgb respectively corresponding to the transferred materials. That is, the thermal printer 100 performs the cleaning process Aa using the region Rga being a non-transfer region. Further, the thermal printer 100 performs the cleaning process Ab using the region Rgb being a non-transfer region. Still further, in the cleaning control process A, the cleaning process Aa is performed before each of a plurality of (three times of) k-th printing processes respectively for transferring a plurality of types of the dyes (the dyes 7*y*, 7*m*, 7*c*) on the recording paper 6 is performed.

Then, similarly to the first embodiment, the cutting process in Step S190 is performed, and the cleaning control process A ends.

Note that, in Step S110, when it is determined that the subject image is a low-density image, similarly to the first embodiment, the processes of Steps S221, S230, S290 are performed.

As has been described above, according to the present embodiment, before transfer of each of the transferred materials is performed, cleaning of the thermal head 5 is performed. Accordingly, the present embodiment also exhibits the effect similar to that exhibited by the first embodiment.

Note that, in the present embodiment, while the entire regions Rga, Rgb including one of the mark MK1*s* and the mark MK1*a* are used in the cleaning processes Aa, Ab, the present invention is not limited thereto. When the width of each of the regions Rga, Rgb is fully long, the process of rewinding the ink ribbon performed before the process of transferring the transferred materials can be dispensed with.

Further, while both the regions Rga, Rgb corresponding to the transferred materials are used in the cleaning process of the present embodiment, the present invention is not limited thereto. In the cleaning process, just one of the regions Rga, Rgb respectively corresponding to the transferred materials may be used. Further, in the cleaning process, at least one of the regions Rga, Rgb corresponding to just a single transferred material may be used. Still further, in the cleaning process, the regions Rga, Rgb corresponding to a plurality of transferred materials in combination may be used.

Third Embodiment

In the structure of the present embodiment, cleaning is performed using the non-transfer region for a plurality of times (hereinafter also referred to as the "structure CtB"). The thermal printer in the structure CtB is the thermal printer 100.

Figure 11:
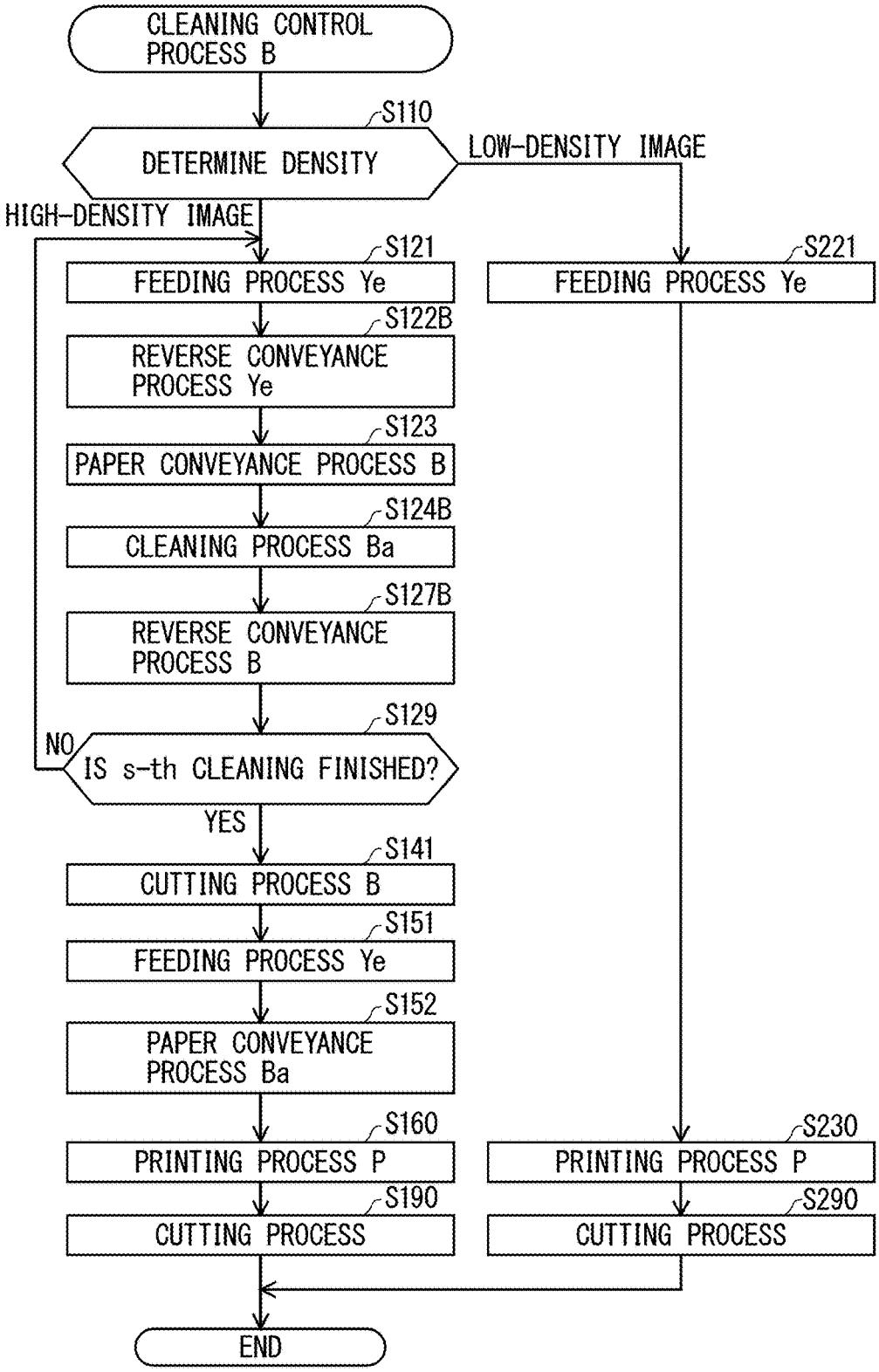
FIG. 11 is a flowchart of a cleaning control process B according to a third embodiment of the present invention.

Next, a description will be given of a process performed by the thermal printer 100 to which the structure CtB is applied (hereinafter referred to as the "cleaning control process B"). FIG. 11 is a flowchart of the cleaning control process B according to a third embodiment of the present invention.

Figure 12:
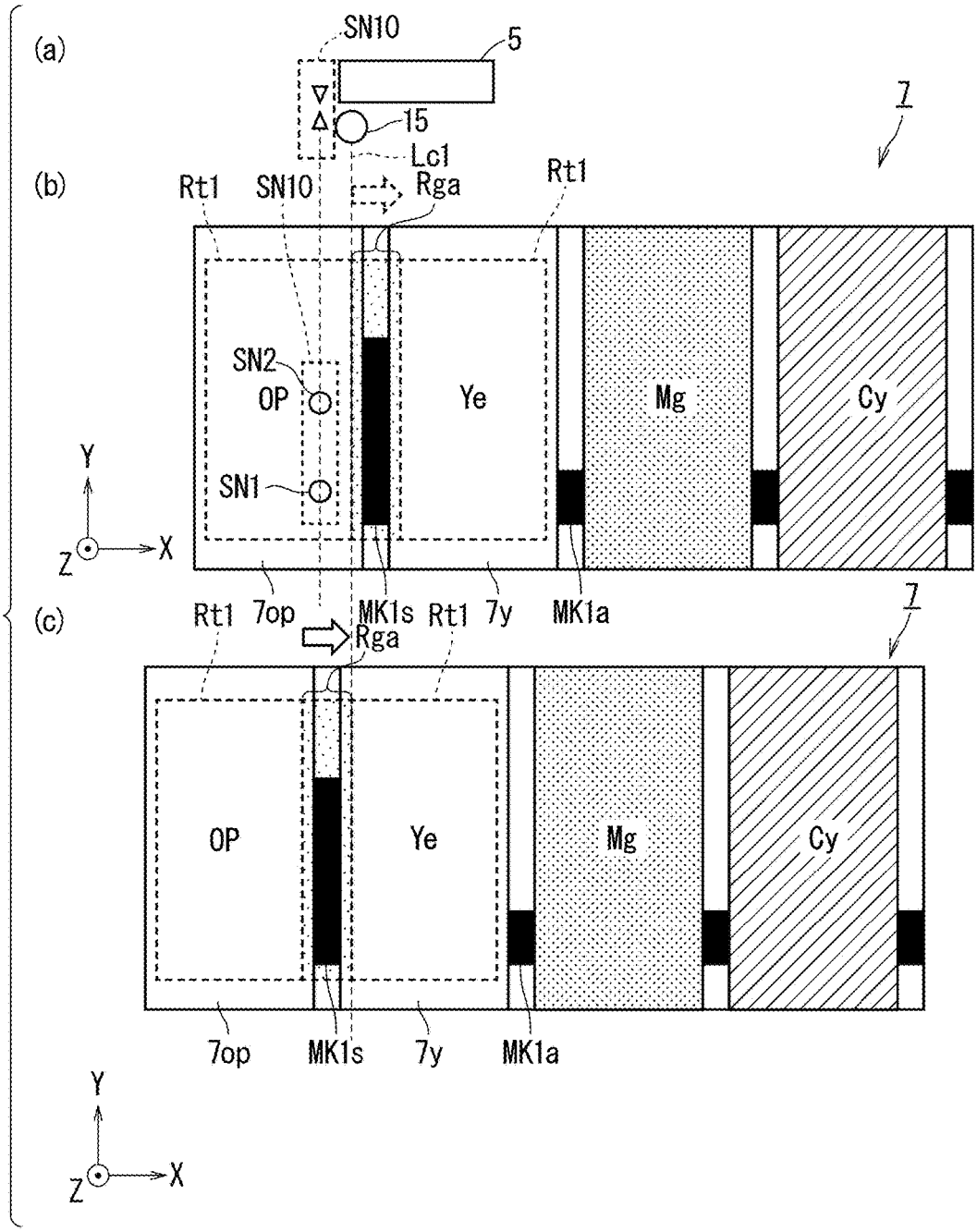
FIG. 12 is a diagram for describing part of the cleaning control process B according to the third embodiment of the present invention.

When the thermal printer 100 receives a print instruction and image data D1 from the information processing apparatus 200, the cleaning control process B is executed. FIG. 12 is a diagram showing part of the cleaning control process B according to the third embodiment of the present invention. Part (a) in FIG. 12 is a diagram that mainly shows the thermal head 5 and the sensor SN10. Part (b) in FIG. 12 and part (c) in FIG. 12 are each a plan view for describing part of the cleaning control process B.

Note that, part (b) in FIG. 12 shows the region Rga described in the second embodiment. The region Rga according to the present embodiment is the region between the transfer region Rt1 of the protective material lop and the transfer region Rt1 of the dye 7*y* in the ink ribbon 7. That is, the region Rga according to the present embodiment is a region adjacent to the transfer region Rt1 of the dye 7*y*. The region Rga is a region not used in printing. Further, the region Rga includes the mark MK1*s*.

In FIG. 11, a process denoted by the step number identical to that in FIG. 8 is the process identical to that described in the first embodiment and, therefore, a detailed description thereof will not be repeated. In the following, a description will be given mainly of the difference from the first embodiment.

In the cleaning control process B, similarly to the first embodiment, the process of Step S110 is performed. When the subject image is a high-density image, the process transits to Step S121.

In Step S121, similarly to the first embodiment, the feeding process Ye is performed.

In Step S122B, the reverse conveyance process Ye is performed. In the reverse conveyance process Ye, the ink ribbon 7 is rewound. Specifically, in the reverse conveyance process Ye, the conveyance unit 40 conveys the ink ribbon 7 in the reverse conveyance direction (the X direction), so that the leading end (the left end) of the region Rga adjacent to the transfer region Rt1 of the dye 7*y* is set to the heating position LC1. The leading end (the left end) of the region Rga is the trailing end (the right end) of the transfer region Rt1 of the protective material 7*op*. Thus, as shown in part (b) in FIG. 12, the trailing end (the right end) of the transfer region Rt1 of the protective material 7*op* is set to the heating position LC1.

In Step S123, the paper conveyance process B is performed. In the paper conveyance process B, the recording paper 6 is conveyed in the ejecting direction. Specifically, in the paper conveyance process B, the conveyance roller pair 13 conveys the recording paper 6 in the paper reverse conveyance direction, so that the position of the leading end of the image forming region of the recording paper 6 is positioned on the paper reverse conveyance direction (X direction) side relative to the heating position LC1 by the above-described length Lsc. The leading end of the image forming region of the recording paper 6 is the end corresponding to the position in the image forming region where transfer of the transferred material is started. Thus, the position of the leading end of the image forming region of the recording paper 6 is set to the left end in the transfer region Rt1 of the dye 7*y* in part (b) in FIG. 12.

In Step S124B, a cleaning process Ba is performed. In the cleaning process Ba, firstly, the state of the platen roller 15 is set to the above-described platen contact state. Then, the above-described ribbon conveyance process Aa, the above-described paper conveyance process Aa, and the above-described transfer process Aa are simultaneously performed on the region Rga adjacent to the transfer region Rt1 of the dye 7*y*. As described above, the region Rga is a region not used in printing.

In the ribbon conveyance process Aa, the conveyance unit 40 conveys the ink ribbon 7 in the forward conveyance direction (the −X direction) by the length Lsc while the ink ribbon 7 is in contact with the thermal head 5.

In the paper conveyance process Aa, the conveyance roller pair 13 conveys the recording paper 6 in the paper forward conveyance direction (the −X direction) by the length Lsc.

In the transfer process Aa, over the period in which the ink ribbon 7 and the recording paper 6 are conveyed, the thermal head 5 applies heat of the above-described heat quantity Hq0 to the ink ribbon 7 in accordance with control of the printing control unit 22. Specifically, in the transfer process Aa, the thermal head 5 applies heat of the heat quantity Hq0 to the entire region Rga.

By the ribbon conveyance process Aa, the paper conveyance process Aa, and the transfer process Aa, cleaning of the thermal head 5 can be performed using the region Rga in the ink ribbon 7. Then, the state of the platen roller 15 is set to the above-described platen non-contact state.

In Step S127B, the reverse conveyance process B is performed. In the reverse conveyance process B, the ink ribbon 7 is rewound so that feeding of the dye 7*y* can be performed. Specifically, in the reverse conveyance process B, the conveyance unit 40 conveys the ink ribbon 7 in the reverse conveyance direction, so that the position of the sensor SN10 as seen in a plan view (the XY-plane) is set to the position on the forward conveyance direction (−X direction) side relative to the mark MK1*s* corresponding to the dye 7*y*.

Further, the conveyance roller pair 13 conveys the recording paper 6 in the paper reverse conveyance direction (the X direction) by the shift amount of the ink ribbon 7.

In Step S129, whether or not the cleaning processes for s-times are finished is determined. Specifically, the control unit 21 determines whether or not the cleaning process Ba has been performed for s times. "s" is a natural number equal to or greater than 2. For example, s is an integer falling within a range from 2 to 5 inclusive. When YES in Step S129, the process transits to Step S141. On the other hand, when NO in Step S129, again the process of Step S121 is performed.

In the cleaning control process B, the processes from Steps S121 to S127B are repeatedly performed until the determination result is YES in Step S129. Thus, the cleaning process Ba is repeatedly performed. That is, the thermal printer 100 repeatedly performs the cleaning process Ba using the region Rga being a non-transfer region.

Hereinafter, in the recording paper 6, a portion corresponding to the region Rga used in the cleaning process Ba is also referred to as the "paper cleaning part". The paper cleaning part is the portion in the recording paper 6 other than the image forming region. Specifically, the paper cleaning part is the portion, in the recording paper 6, being in contact with the region Rga of the ink ribbon 7 in the period in which the cleaning process Ba is performed.

In Step S141, the cutting process B is performed. In the cutting process B, the recording paper 6 including the paper cleaning part is conveyed by a predetermined length. Then, the cut part Ct1 cuts the recording paper 6 so that the paper cleaning part is separated from the recording paper 6. Then, by an ejection mechanism (not shown), the paper cleaning part is ejected from the thermal printer 100.

In Step S151, similarly to the first embodiment, the feeding process Ye is performed.

In Step S152, the paper conveyance process Ba is performed. In the paper conveyance process Ba, the conveyance roller pair 13 conveys the recording paper 6 so that the position of the leading end of the image forming region of the recording paper 6 is set to the heating position LC1.

Then, the state of the platen roller 15 is set to the above-described platen contact state and, similarly to the first embodiment, the printing process P (S160) and the cutting process (S190) are performed.

Note that, in Step S110, when it is determined that the subject image is a low-density image, similarly to the first embodiment, the processes of Steps S221, S230, S290 are performed.

Thus, when the subject image is a low-density image, the cleaning process Ba is not performed. That is, in the cleaning control process B, when the image density is greater than the reference density, the thermal printer 100 repeatedly performs the cleaning process Ba. Further, in the cleaning control process B, the thermal printer 100 performs the cleaning process Ba before performing the printing process P.

As has been described above, according to the present embodiment, the cleaning process Ba is repeatedly performed. Accordingly, the present embodiment also exhibits the effect similar to that exhibited by the first embodiment.

Note that, the processes from Steps S121 to S141 including the cleaning process Ba may be performed before the process for transferring each of the transferred materials. Further, the processes from Steps S121 to S141 including the cleaning process Ba may be performed after the printing process P ends.

(Functional Block Diagram)

Figure 13:
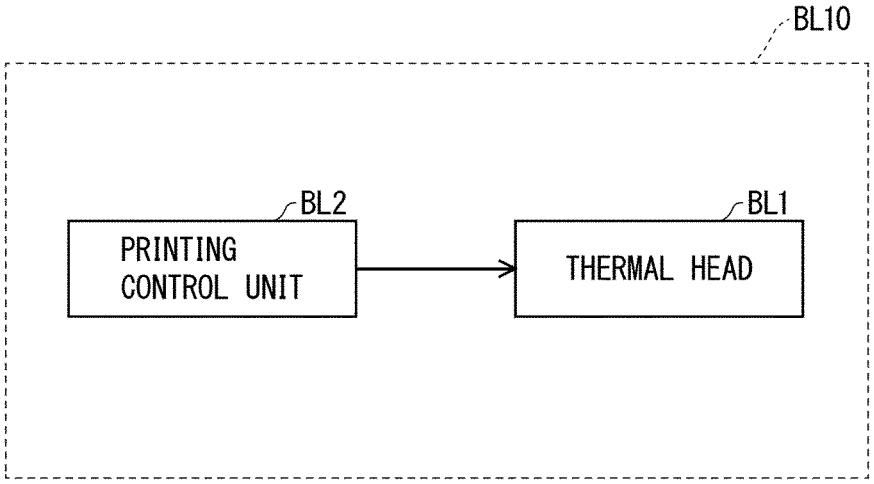
FIG. 13 is a block diagram showing the characteristic functional structure of the thermal printer.

FIG. 13 is a block diagram showing the characteristic functional structure of a thermal printer BL10. The thermal printer BL10 corresponds to the thermal printer 100. That is, FIG. 13 is a block diagram showing, out of the functions of the thermal printer BL10, the main functions relating to the present invention present.

Using an ink ribbon having a function of performing cleaning of the thermal head by being heated, the thermal printer BL10 performs a printing process for forming an image on recording paper.

The thermal printer BL10 functionally includes a thermal head BL1 and a printing control unit BL2.

The thermal head BL1 has a function of emitting heat. The thermal head BL1 corresponds to the thermal head 5. The printing control unit BL2 controls the thermal head BL1. The printing control unit BL2 corresponds to the printing control unit 22.

The thermal printer BL10 performs a cleaning process of performing cleaning of the thermal head BL1. In the cleaning process, in accordance with control of the printing control unit BL2, the thermal head BL1 applies, to the ink ribbon, heat of a heat quantity with which the dye applied onto the ink ribbon does not sublime and with which the cleaning is performed.

(Other Modification)

In the foregoing, while the description has been given of the thermal printer of the present invention based on each of the embodiments, the present invention is not limited to the embodiments. The present invention includes any modification of the embodiments that the person skilled in the art may arrive at, within a range not departing from the spirit of the present invention. That is, within the scope of the present invention, the embodiments may be freely combined, modified, or omitted as appropriate.

The thermal printer 100 may not necessarily include all the constituents shown in the drawings. That is, the thermal printer 100 should include the minimum constituents with which the effect of the present invention can be realized.

Further, the present invention can be realized as a cleaning method in which the operations of the characteristic structures of the thermal printer 100 are realized by steps.

For example, in the above-described embodiments, while the ink ribbon provided with the protective material lop is used, the present invention is not limited thereto. In the above-described embodiments, an ink ribbon not provided with the protective material lop may be used.

While the present invention has been described in detail, the foregoing description is of an illustrative nature in every aspect, and the present invention is not limited thereto. It is to be construed that numerous modifications having not exemplarily shown may be assumed without departing from the scope of the present invention.

EXPLANATION OF REFERENCE SIGNS

5, BL1: thermal head
6: recording paper
7: ink ribbon
22, BL2: printing control unit
100, BL10: thermal printer
Ct1: cut part

The invention claimed is:

1. A thermal printer performing a printing process for forming an image on recording paper using an ink ribbon having a function of cleaning a thermal head by being heated, the thermal printer comprising:

the thermal head having a function of emitting heat; and a printing control unit controlling the thermal head, wherein the thermal printer performs a cleaning process to clean the thermal head, and in the cleaning process, in accordance with control of the printing control unit, the thermal head applies, to the ink ribbon, heat of a heat quantity with which a dye applied onto the ink ribbon does not sublime and with which the cleaning process is performed by heating at least one lubricating component on a back surface of the ink ribbon so that the at least one lubricating component becomes molten and, when the a last one lubricating component is molten, at least one cleaning component on the back surface of the ink ribbon prevents fragments from attaching to the thermal head, wherein the at least one lubricating component is separated from the at least one cleaning component.

2. The thermal printer according to claim 1, wherein the thermal printer performs the cleaning process before performing a process for transferring the dye onto the recording paper.

3. The thermal printer according to claim 1, further comprising a calculation unit calculating an image density being a density of an image to be formed on the recording paper, wherein the thermal printer performs the cleaning process when the image density is greater than a predetermined reference density.

4. The thermal printer according to claim 1, wherein in the ink ribbon, a transfer region to which the dye used in forming the image is applied exists, and the thermal printer performs the cleaning process using a region in the ink ribbon other than the transfer region.

5. The thermal printer according to claim 1, wherein in the ink ribbon, a transfer region to which the dye is used in forming the image is applied exists, and the thermal printer performs the cleaning process using the entire transfer region of the ink ribbon.

6. The thermal printer according to claim 1, wherein a plurality of types of the dyes are applied onto the ink ribbon, and the thermal printer performs the cleaning process before performing each of a plurality of processes respectively for transferring the plurality of types of the dyes onto the recording paper.

7. The thermal printer according to claim 4, wherein the thermal printer repeatedly performs the cleaning process using the region in the ink ribbon other than the transfer region, and the thermal printer further comprises a cut part cutting the recording paper so that a portion in the recording paper corresponding to the region used in the cleaning process is separated from the recording paper.

* * * * *